US011656580B2

(12) United States Patent
Kimura et al.

(10) Patent No.: US 11,656,580 B2
(45) Date of Patent: May 23, 2023

(54) ELECTRONIC WATCH

(71) Applicant: CITIZEN WATCH CO., LTD., Nishitokyo (JP)

(72) Inventors: Shogo Kimura, Tokyo (JP); Akinari Takada, Mitaka (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 1078 days.

(21) Appl. No.: 16/364,612

(22) Filed: Mar. 26, 2019

(65) Prior Publication Data

US 2019/0302699 A1 Oct. 3, 2019

(30) Foreign Application Priority Data

Mar. 27, 2018 (JP) ..... JP2018-059347
Mar. 8, 2019 (JP) ..... JP2019-042178

(51) Int. Cl.
*G04C 10/04* (2006.01)
*G04C 3/16* (2006.01)

(52) U.S. Cl.
CPC ..... *G04C 10/04* (2013.01); *G04C 3/16* (2013.01)

(58) Field of Classification Search
CPC ..... G04C 3/16; G04C 10/04; G04G 19/12
See application file for complete search history.

(56) References Cited

U.S. PATENT DOCUMENTS 6,320,822 B1 * 11/2001 Okeya ..... G04G 19/12 307/130
6,463,010 B1 * 10/2002 Nakamiya ..... G04C 10/00 368/64
6,542,440 B1 * 4/2003 Kihara ..... G04G 19/12 368/204
6,693,851 B1 * 2/2004 Fujisawa ..... G04C 10/00 368/203

(Continued)

FOREIGN PATENT DOCUMENTS

JP 8-278380 A 10/1996
JP 3525897 B2 5/2004

(Continued)

OTHER PUBLICATIONS

Notice of Reasons for Refusal dated Aug. 2, 2022 from the Japanese Patent Office in Japanese Application No. 2019-042178.

*Primary Examiner* — Daniel P Wicklund
(74) *Attorney, Agent, or Firm* — Sughrue Mion, PLLC

(57) ABSTRACT

An electronic watch includes a power generating mechanism; a battery that is charged with power generated by the power generating mechanism; hands that include a second hand; a driving source that rotates the hands; a driving circuit that drives the driving source with power supplied by the battery; and a control circuit that controls the driving circuit. The control circuit executes a first stopping operation for stopping the driving circuit and the control circuit in a power saving mode for suppressing power consumption and when a first determination time elapses without any power being generated by the power generating mechanism. The (Continued)

control circuit executes a second stopping operation for stopping the driving circuit and the control circuit in the power saving mode and when a second determination time elapses while a voltage of the battery is at a level equal to or lower than a predetermined level.

16 Claims, 13 Drawing Sheets

(56) References Cited

U.S. PATENT DOCUMENTS

| | | | | |
|---|---|---|---|---|
| 7,102,964 | B2 * | 9/2006 | Fujisawa | G04G 19/08 368/204 |
| 7,161,874 | B2 | 1/2007 | Ichikawa et al. | |
| 9,575,526 | B2 * | 2/2017 | Nagahama | G04C 10/00 |
| 2001/0043512 | A1 * | 11/2001 | Igarashi | G04C 17/00 368/204 |
| 2002/0183865 | A1 | 12/2002 | Ichikawa et al. | |
| 2004/0062147 | A1 * | 4/2004 | Morokawa | G04B 11/024 368/80 |
| 2004/0246821 | A1 * | 12/2004 | Fujisawa | G04G 19/08 368/204 |
| 2007/0030244 | A1 * | 2/2007 | Ishii | G09G 3/344 345/107 |
| 2008/0225648 | A1 * | 9/2008 | Kawaguchi | G04C 10/04 368/66 |
| 2012/0056480 | A1 * | 3/2012 | Sakumoto | G04C 10/04 323/265 |
| 2012/0057436 | A1 * | 3/2012 | Sakumoto | G04G 19/12 368/204 |
| 2012/0057438 | A1 * | 3/2012 | Shimizu | G04G 19/12 368/204 |
| 2013/0194896 | A1 * | 8/2013 | Kato | G04B 99/00 368/66 |
| 2017/0075316 | A1 * | 3/2017 | Berdinis | G06F 1/163 |
| 2018/0275613 | A1 * | 9/2018 | Ukawa | G04B 47/06 |

FOREIGN PATENT DOCUMENTS

| | | | |
|---|---|---|---|
| JP | 2017-96776 | A | 6/2017 |
| WO | 01/98843 | A1 | 12/2001 |

* cited by examiner

ELECTRONIC WATCH

CROSS-REFERENCE TO RELATED APPLICATION(S)

The present application claims priority to and incorporates by reference the entire contents of Japanese Patent Application No. 2018-059347 filed in Japan on Mar. 27, 2018 and Japanese Patent Application No. 2019-042178 filed in Japan on Mar. 8, 2019.

BACKGROUND OF THE INVENTION

1. Field of the Invention

The present invention relates to an electronic watch.

2. Description of the Related Art

A technology for stopping the operation of an electronic device has conventionally been available. Japanese Patent No. 3525897 discloses a technology related to an electronic device including a mode switching unit that switches the operation mode of a driven unit between a driving mode in which the driven unit is driven in a normal operation, and a power saving mode, and also including an operation stopping unit that stops the operation of a driving control unit when the electric energy charged in a power supply unit drops to a level lower than a predetermined level while the driven unit is in the power saving mode to which the mode switching unit has switched.

In relation to extending the operating time of an electronic watch, there is a room for further improvement. For example, if a more appropriate condition is used to stop the electronic watch, it should be possible to suppress power consumption and to extend the operating time.

SUMMARY OF THE INVENTION

The present invention is made in view of such a situation, and provides an electronic watch that can extend the operating time of the electronic watch.

An electronic watch according to one aspect of the present invention includes a power generating mechanism; a battery that is charged with power generated by the power generating mechanism; hands that include a second hand; a driving source that rotates the hands; a driving circuit that drives the driving source with power supplied by the battery; and a control circuit that controls the driving circuit, wherein the control circuit executes a first stopping operation for stopping the driving circuit and the control circuit in a power saving mode for suppressing power consumption and when a first determination time elapses without any power being generated by the power generating mechanism, and the control circuit executes a second stopping operation for stopping the driving circuit and the control circuit in the power saving mode and when a second determination time elapses while a voltage of the battery is at a level equal to or lower than a predetermined level.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An electronic watch according to an embodiment of the present invention will now be explained in detail with reference to some drawings. The embodiment is, however, not intended to limit the scope of the present invention in any way. Furthermore, the elements described below include those that can be easily thought of by those skilled in the art, or those that are substantially the same.

EMBODIMENT

Figure 1:
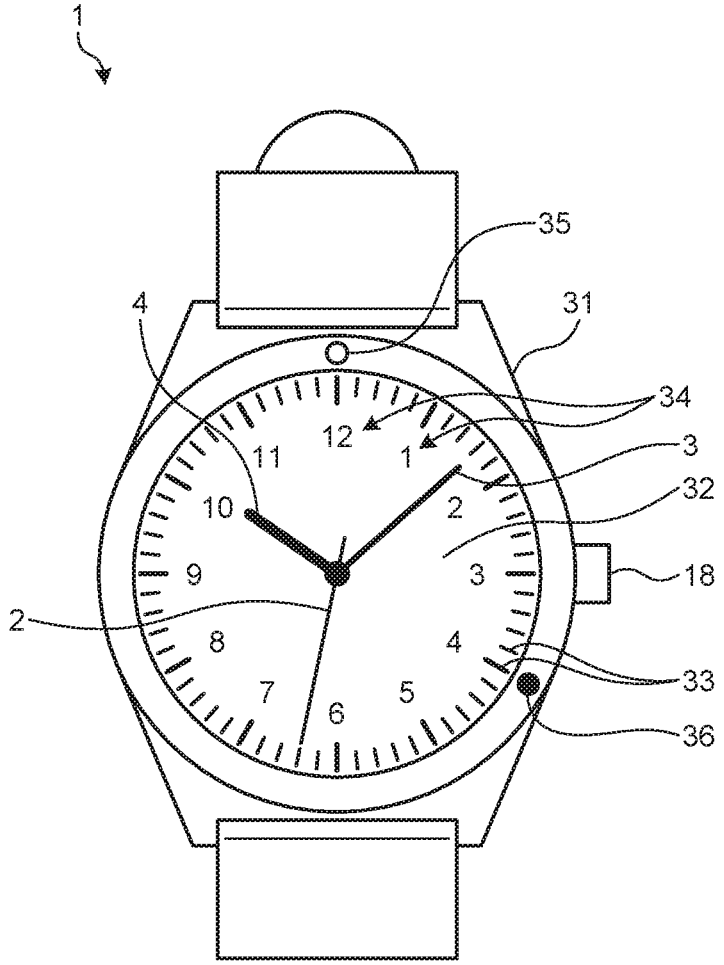
FIG. 1 is a front view of an electronic watch according to an embodiment.
Figure 2:
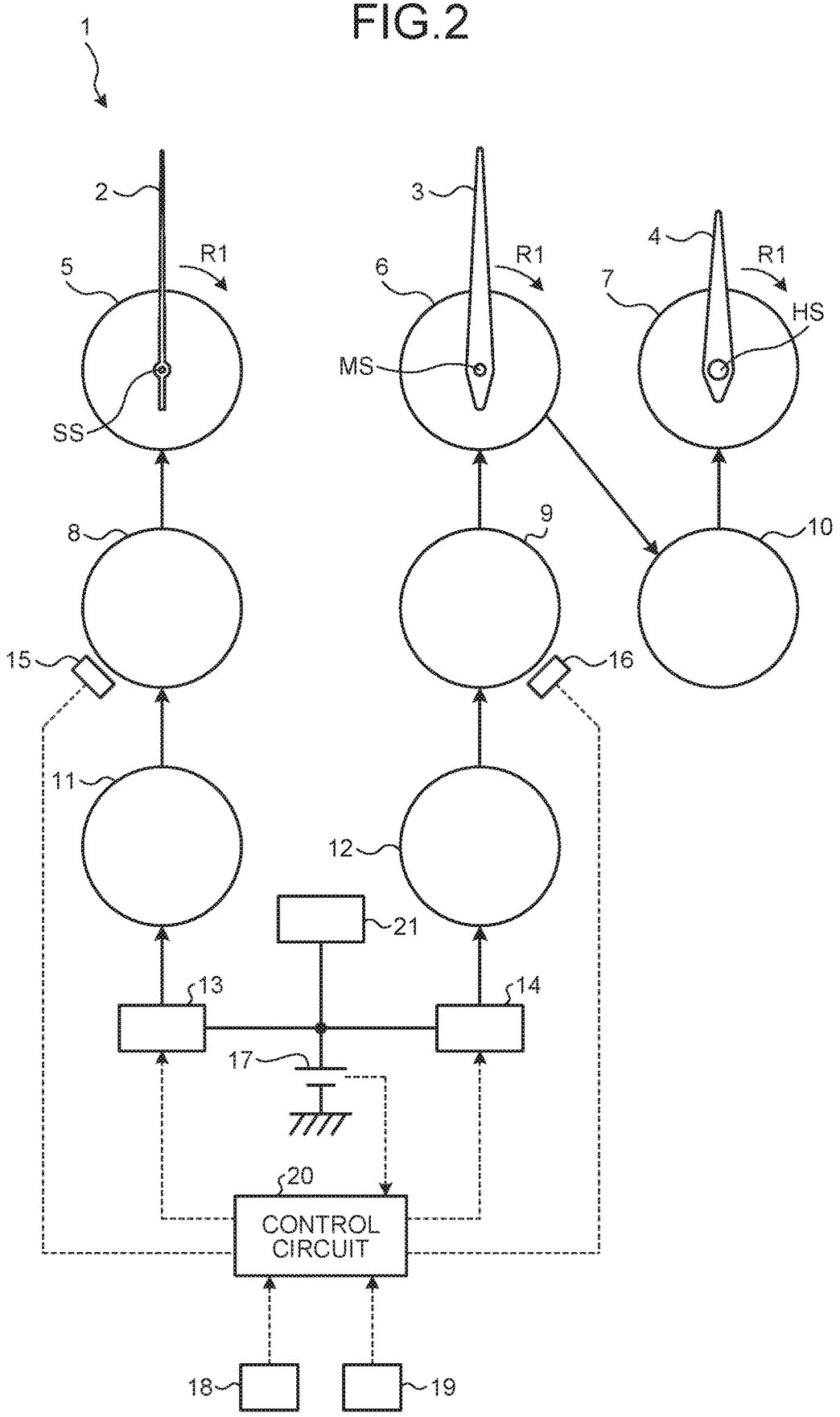
FIG. 2 is a block diagram of the electronic watch according to the embodiment.
Figure 3:
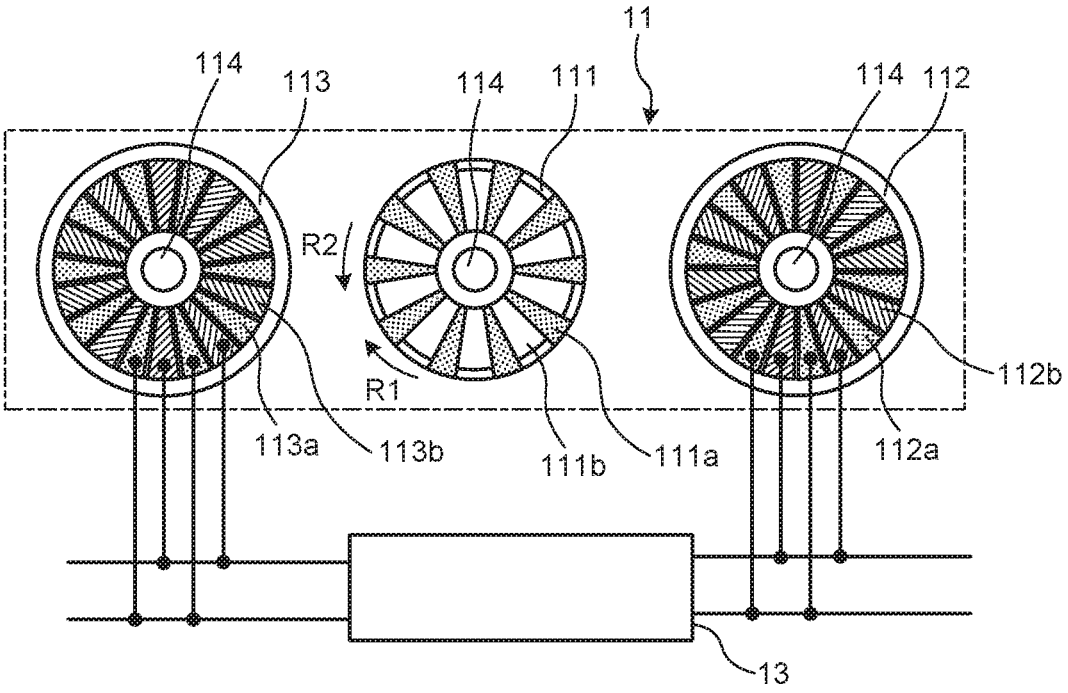
FIG. 3 is a schematic view of a structure of an electrostatic motor according to the embodiment.
Figure 4:
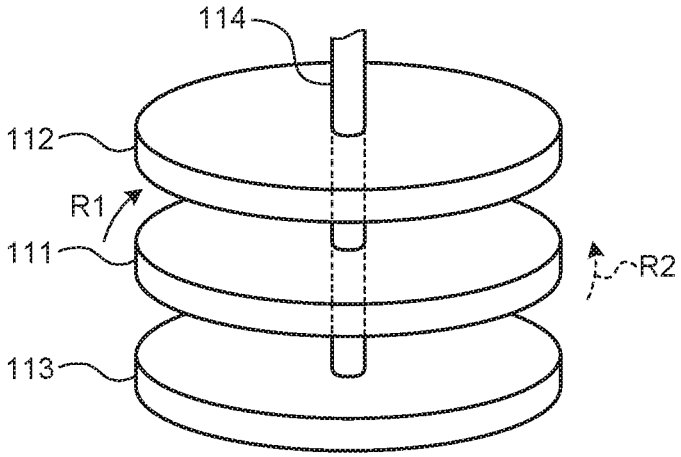
FIG. 4 is a perspective view of the electrostatic motor according to the embodiment.
Figure 5:
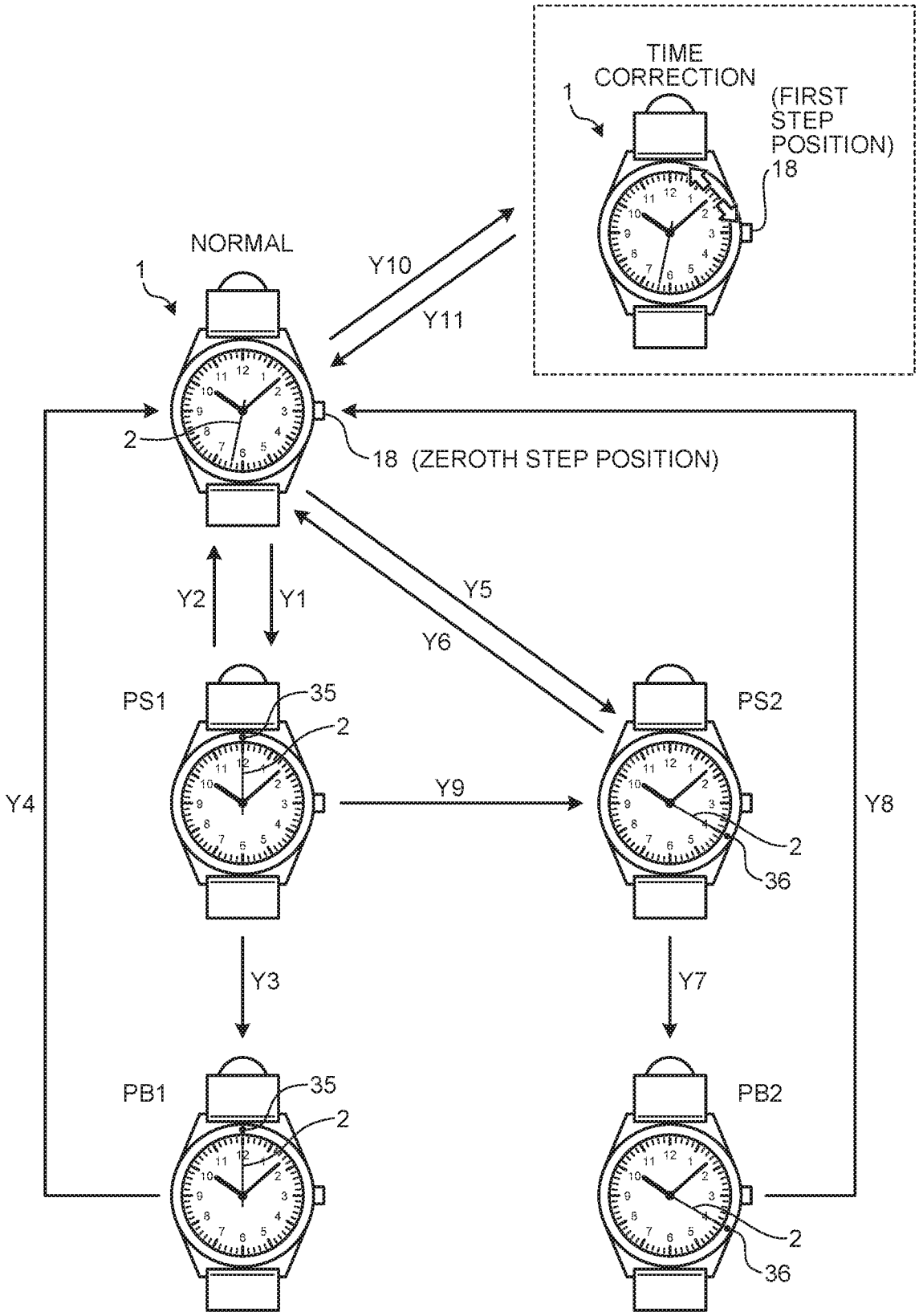
FIG. 5 is a schematic view for explaining a mode transition in the electronic watch according to the embodiment.
Figure 6:
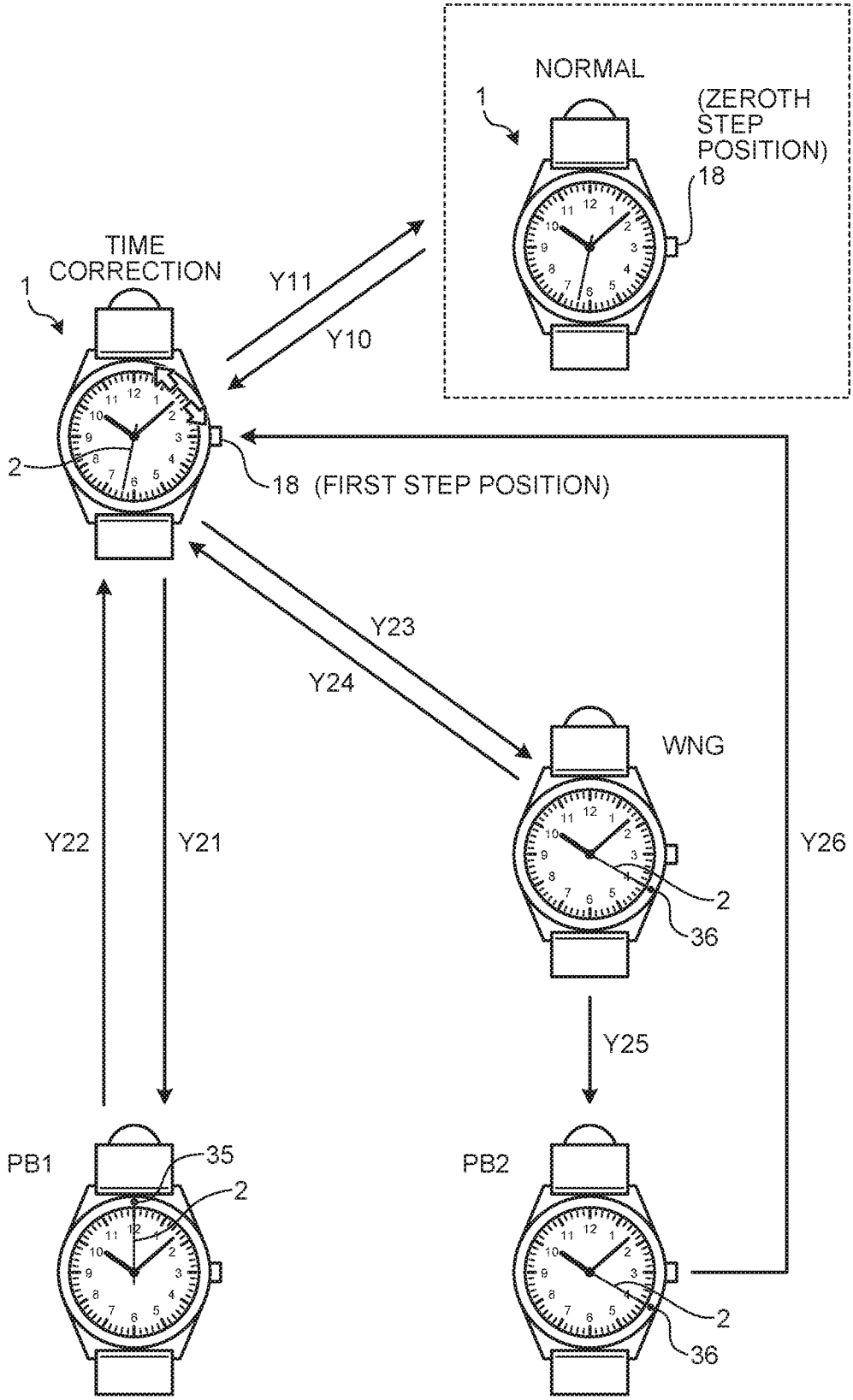
FIG. 6 is another schematic view for explaining the mode transition in the electronic watch according to the embodiment.

An embodiment will now be explained with reference to FIGS. 1 to 6. The embodiment is related to an electronic watch. FIG. 1 is a front view of the electronic watch according to the embodiment. FIG. 2 is a block diagram of the electronic watch according to the embodiment. FIG. 3 is a schematic view of a structure of an electrostatic motor according to the embodiment. FIG. 4 is a perspective view of the electrostatic motor according to the embodiment. FIG. 5 is a schematic view for explaining a mode transition in the electronic watch according to the embodiment. FIG. 6 is another schematic view for explaining the mode transition in the electronic watch according to the embodiment.

This electronic watch 1 according to the embodiment is an analog electronic watch that displays time with a second hand 2, a minute hand 3, and an hour hand 4, as illustrated in FIG. 1. The electronic watch 1 includes an external case 31, a dial plate 32, the second hand 2, the minute hand 3, the hour hand 4, and an operation unit 18. The electronic watch 1 according to the embodiment is a wrist watch worn on the wrist of a user. The electronic watch 1 displays the current time with the three hands (the second hand 2, the minute hand 3, and the hour hand 4).

The dial plate 32 includes scales 33 and hour marks 34. The scales 33 are the scales pointed by the hands. The scales 33 are plotted at a predetermined interval to the outer periphery of the dial plate 32 in the circumferential direction. The hour marks 34 are numbers representing the time corresponding to the scales 33. The operation unit 18 is an operation input unit that is operated by the user. The operation unit 18 according to the embodiment is a crown. With the operation unit 18 pulled out, the electronic watch 1 receives various types of corrections from users. With the operation unit 18 pulled out one step, the electronic watch 1 allows a user to correct the positions of the hour hand 4 and the minute hand 3.

On the external case 31, a power saving indicator 35 and a charge warning indicator 36 are provided. The power saving indicator 35 is a character or a symbol for indicating that the electronic watch 1 is in a power saving mode. The electronic watch 1 causes the second hand 2 to point to the power saving indicator 35 to indicate that the current mode is the power saving mode, as will be described later. The power saving indicator 35 according to the embodiment is provided at the position of 12 o'clock. The electronic watch 1 causes the second hand 2 to point to the charge warning indicator 36 when a charge warning condition is satisfied, as will be described later. The charge warning indicator 36 according to the embodiment is provided at the position of 4 o'clock. The power saving indicator 35 and the charge warning indicator 36 may also be provided on the dial plate 32.

As illustrated in FIG. 2, the electronic watch 1 also includes a second hand wheel 5, a minute hand wheel 6, an hour hand wheel 7, a first reduction mechanism 8, a second reduction mechanism 9, a third reduction mechanism 10, a first motor 11, a second motor 12, a first driving circuit 13, a second driving circuit 14, a first detecting unit 15, a second detecting unit 16, a battery 17, a counter 19, a control circuit 20, and a power generating mechanism 21.

The first motor 11 and the second motor 12 both may be electromagnetic motors, or both may be electrostatic motors driven by an electrostatic force. One of the first motor 11 and the second motor 12 may be an electrostatic motor, and the other may be an electromagnetic motor. Explained in this embodiment is an example in which the first motor 11 is an electrostatic motor, and the second motor 12 is an electromagnetic motor.

The second hand wheel 5 is meshed with the second hand 2, and rotates integrally with the second hand 2. The second hand wheel 5 is fixed to a second hand rotating shaft SS that is a rotating shaft of the second hand 2. The second hand wheel 5 is a rotary gear the outer circumference of which is provided with teeth. The second hand rotating shaft SS is rotatably supported inside of the external case 31.

The minute hand wheel 6 is meshed with the minute hand 3, and rotates integrally with the minute hand 3. The minute hand wheel 6 is fixed to a minute hand rotating shaft MS that is a rotating shaft of the minute hand 3. The minute hand wheel 6 is a rotary gear the outer circumference of which is provided with teeth. The minute hand rotating shaft MS is rotatably supported inside of the external case 31.

The hour hand wheel 7 is meshed with the hour hand 4, and rotates integrally with the hour hand 4. The hour hand wheel 7 is fixed to an hour hand rotating shaft HS that is a rotating shaft of the hour hand 4. The hour hand wheel 7 is a rotary gear the outer circumference of which is provided with teeth. The hour hand rotating shaft HS is rotatably supported inside of the external case 31. The hour hand rotating shaft HS, the minute hand rotating shaft MS, and the second hand rotating shaft SS are positioned coaxially.

The first reduction mechanism 8 meshes the electrostatic motor 11 with the second hand wheel 5. The first reduction mechanism 8 is a reduction gear train including at least one gear, and communicates the turning force generated by the electrostatic motor 11 to the second hand wheel 5. The first reduction mechanism 8 is positioned behind the dial plate 32. The first reduction mechanism 8 changes the speed of rotations of the rotating shaft of the electrostatic motor 11 at a first reduction ratio, and communicates the rotations to the second hand wheel 5.

The second reduction mechanism 9 meshes the electromagnetic motor 12 with the minute hand wheel 6. The second reduction mechanism 9 is a reduction gear train including at least one gear, and communicates the turning force generated by the electromagnetic motor 12 to the minute hand wheel 6. The second reduction mechanism 9 is positioned behind the dial plate 32. The second reduction mechanism 9 changes the speed of rotations of the rotating shaft of the electromagnetic motor 12 at a second reduction ratio, and communicates the rotations to the minute hand wheel 6.

The third reduction mechanism 10 meshes the electromagnetic motor 12 with the hour hand wheel 7. The third reduction mechanism 10 is a reduction gear train including at least one gear, and communicates the turning force generated by the electromagnetic motor 12 to the hour hand wheel 7. The third reduction mechanism 10 is positioned behind the dial plate 32. The third reduction mechanism 10 changes the speed of the rotations of the minute hand wheel 6 at a third reduction ratio, and communicates the rotations to the hour hand wheel 7. The third reduction mechanism 10 according to the embodiment is interposed between the minute hand wheel 6 and the hour hand wheel 7.

The electrostatic motor 11 is, for example, an electret motor that uses electret as an electrostatic material, and that drives the rotor in rotation using the electrostatic interaction between a charging unit and an electrode facing thereto. The electrostatic motor 11 causes the second hand 2 to keep rotating, by continuously driving the second hand 2 in rotation. The electrostatic motor 11 includes, as illustrated in FIGS. 3 and 4, a rotor 111, two stators 112, 113, and a rotating shaft 114. The rotor 111 is interposed between the two stators 112, 113. The rotor 111 is positioned coaxially with the two stators 112, 113, in a manner spaced from the two stators 112, 113. The rotating shaft 114 is rotatably supported.

As illustrated in FIG. 2, the electrostatic motor 11 is connected to the battery 17 via the first driving circuit 13. The battery 17 is a chargeable secondary battery. The battery 17 supplies power to the first driving circuit 13 and the second driving circuit 14, which will be described later.

The first driving circuit 13 is electrically connected to the control circuit 20, and is operated in response to a command of the control circuit 20. The first driving circuit 13 generates a driving pulse using the power supplied by the battery 17, and outputs the generated driving pulse to the electrostatic motor 11. The stators 112, 113 generate an electrostatic force using the driving pulse, to apply a turning force to the rotor 111.

The rotor 111 is a disc-shaped member made from a substrate material such as a silicon substrate, a glass epoxy substrate provided with a planer electrode for charging, or an aluminum plate. As illustrated in FIG. 3, a plurality of charging units 111*a* are provided on each side of the rotor 111. The charging units 111*a* are provided at an equal interval along the circumferential direction about the rotating shaft 114. In the rotor 111, the charging units 111*a* on the top surface and the bottom surface are provided at the same positions in the circumferential direction. The charging unit 111*a* according to the embodiment is a thin film made of an electret material. The rotor 111 has through-holes 111*b* that are provided between the adjacent charging units 111*a*.

The stators 112, 113 are fixed, in a manner disabled to rotate, and face each other in the axial direction of the rotating shaft 114. The stators 112, 113 have a disc-like shape, for example. The surface of the stator 112 facing the rotor 111 is provided with a plurality of first electrodes 112*a* and a plurality of second electrodes 112*b*. The first electrodes 112*a* and the second electrodes 112*b* are fixed electrodes. The first electrodes 112*a* and the second electrodes 112*b* are positioned alternatingly in the circumferential direction.

Each one of the first electrodes 112*a* is electrically connected to the first driving circuit 13 via a common wiring. In other words, a common driving pulse is input to the first electrodes 112*a*. Each one of the second electrodes 112*b* is electrically connected to the first driving circuit 13 via the common wiring. In other words, a common driving pulse is input to the second electrodes 112*b*.

The surface of the stator 113 facing the stator 111 is provided with a plurality of third electrodes 113*a* and a plurality of fourth electrodes 113*b*. The third electrodes 113*a* and the fourth electrodes 113*b* are fixed electrodes. The third electrodes 113*a* and the fourth electrodes 113*b* are provided alternatingly in the circumferential direction.

Each one of the third electrodes 113*a* is electrically connected to the first driving circuit 13 via a common wiring. In other words, a common driving pulse is input to the third electrodes 113*a*. Each one of the fourth electrodes 113*b* is electrically connected to the first driving circuit 13 via a common wiring. In other words, a common driving pulse is input to the fourth electrodes 113*b*.

Each of the electrodes 112*a*, 112*b*, 113*a*, 113*b* generates an attractive or a repulsive force with respect to the charging unit 111*a*, depending on the polarity generated by the driving pulse. The first driving circuit 13 outputs a driving pulse to each of the electrodes 112*a*, 112*b*, 113*a*, 113*b* at a phase different from one another. As a result, the polarities of the electrodes 112*a*, 112*b*, 113*a*, 113*b* alternate at phases that are different from one another. By applying the driving pulses to the electrodes 112*a*, 112*b*, 113*a*, 113*b*, the first driving circuit 13 rotates the rotor 111 in a forward rotating direction R1 or a reverse rotating direction R2. The forward rotating direction R1 is a rotating direction in a clockwise direction in a view from the front side of the dial plate 32. The reverse rotating direction R2 is a rotating direction opposite to the forward rotating direction R1.

In FIG. 3, because the electrodes 112*a*, 112*b* on the top surface are provided in a manner displaced by a distance equal to a half the width of the electrodes in the circumferential direction with respect to the electrodes 113*a*, 113*b* that are provided on the bottom surface, the phase of a driving pulse output to the electrodes 112*a*, 112*b* is shifted from that of the driving pulse output to the electrodes 113*a*, 113*b*. In a configuration in which the electrodes 112*a*, 112*b* on the top surface are positioned symmetrically with respect to the electrodes 113*a*, 113*b* on the bottom surface, the same driving pulse that is applied to the electrodes 112*a*, 112*b* on the top surface may be applied to the electrodes 113*a*, 113*b* on the bottom surface.

The first driving circuit 13 keeps rotating the second hand 2 by keeping outputting the driving pulse at a first driving frequency. The first driving frequency is a frequency at which the second hand 2 is rotated 1/60 per 1 second in the forward rotating direction R1. The electrostatic motor 11 generates a turning force in the forward rotating direction R1, with the driving pulse at the first driving frequency. The turning force of the electrostatic motor 11 causes the second hand 2 to rotate in the forward rotating direction R1.

The electromagnetic motor 12 is a motor using electromagnetic induction, and is a stepping motor, for example. The electromagnetic motor 12 rotates the minute hand 3 and the hour hand 4 by driving these hands intermittently, in a manner repeating a driving state and a temporarily stopped holding state. The electromagnetic motor 12 is connected to the battery 17 via the second driving circuit 14.

The second driving circuit 14 is electrically connected to the control circuit 20, and is caused to operate in response to a command of the control circuit 20. The second driving circuit 14 generates a driving pulse using the power supplied by the battery 17, and outputs the generated driving pulse to the electromagnetic motor 12. With the driving pulse, the stator generates a magnetic field in the electromagnetic motor 12, and causes the rotor to rotate.

The control circuit 20 is a circuit that controls driving of the electrostatic motor 11 and the electromagnetic motor 12. The control circuit 20 includes a timing unit (timing circuit) for calculating an internal time of the electronic watch 1. The control circuit 20 according to the embodiment calculates the internal time based on a signal output from the counter 19. The counter 19 generates a pulse signal from the clock signal generated by the oscillator. The counter 19 outputs a carry-up signal at a predetermined interval, based on the generated pulse signal. The timing unit in the control circuit 20 calculates the internal time using the carry-up signal acquired from the counter 19.

The control circuit 20 controls the first driving circuit 13 and the second driving circuit 14 so as to synchronize the time indicated by the hands (the second hand 2, the minute hand 3, and the hour hand 4) to the internal time. More specifically, the control circuit 20 causes the first driving circuit 13 to move the second hand 2 in such a manner that the second hand 2 is brought to the position corresponding to the internal time. The control circuit 20 also causes the second driving circuit 14 to move the minute hand 3 and the hour hand 4 in such a manner that the minute hand 3 and the hour hand 4 are brought to the positions corresponding to the internal time.

The control circuit 20 causes the first driving circuit 13 to stop the second hand 2 in response to an operation performed on the operation unit 18. The control circuit 20 determines whether to stop the second hand 2 based on the position of the operation unit 18. The operation unit 18 according to the embodiment is movable to a plurality of step positions in the axial direction of the operation unit 18. Among those step positions of the operation unit 18, the position pushed to the furthest level toward the center of the watch will be referred to as a "zeroth step position", and the step position pulled out first step from the zeroth step position will be referred to as a "first step position".

When the operation unit 18 is at the first step position, the minute hand wheel 6 or the hour hand wheel 7 becomes meshed with the operation unit 18. In such a case, the rotations of the minute hand 3 and the hour hand 4 are mechanically restricted. At the first step position, the minute hand 3 and the hour hand 4 are rotated in a manner geared by the rotations of the operation unit 18. The user can correct the time of the electronic watch 1 by positioning the operation unit 18 to the first step position. When the operation unit 18 is at the first step position, the control circuit 20 stops the second hand 2. For example, the control circuit 20 stops the second hand 2 promptly upon detecting that the operation unit 18 is moved to the first step position, for example. When the control circuit 20 stops the second hand 2, the control circuit 20 causes the first driving circuit 13 to execute maintaining control for maintaining the rotational position of the second hand 2.

In the maintaining control, the first driving circuit 13 fixes the polarities of at least one pair of electrodes, among the four pairs including the first electrodes 112*a* to the fourth electrodes 113*b*, to the positive or the negative pole. The first driving circuit 13 may also fix the polarities of each one of the four pairs of electrodes including the first electrodes 112*a* to the fourth electrodes 113*b*. The polarity of each of the electrodes 112*a*, 112*b*, 113*a*, 113*b* may be fixed at a polarity at which the electrodes 112*a*, 112*b*, 113*a*, 113*b* generates an attractive force toward the charging units 111*a* provided at positions facing thereto, for example. By fixing the polarity of each of the electrodes 112*a*, 112*b*, 113*a*, 113*b*, the rotor 111 is stopped rotating. If the operation unit 18 is detected to be at the zeroth step position, the control circuit 20 starts moving the second hand 2, the minute hand 3, and the hour hand 4.

The power generating mechanism 21 is connected to the battery 17. The battery 17 stores therein the power generated by the power generating mechanism 21. The power generating mechanism 21 according to the embodiment is an electrostatic-induction power generating mechanism. It should be needless to say that a mechanism such as a solar power generating mechanism, an electromagnetic power generating mechanism, a thermal power generating mechanism, or an electromagnetic-induction power generating mechanism may be used as the power generating mechanism 21. The power generating mechanism 21 includes a rotor and a stator that are alike the rotor 111 and the stator 112 described above, for example. The rotor is meshed with, via a gear train, a rotating weight that is rotated by the movement of the arm on which the electronic watch 1 is worn, for example. When the electronic watch 1 is vibrated, the rotor is caused to rotate in a manner geared with the rotating weight, and power is generated based on the relative rotation of the rotor with respect to the stator. The electronic watch 1 includes a voltage detecting unit that detects the voltage of the battery 17. The control circuit 20 acquires a voltage value of the battery 17 from the voltage detecting unit.

The control circuit 20 acquires the position of the second hand 2 based on a detection result of the first detecting unit 15. The first detecting unit 15 is, for example, an optical detecting mechanism, and includes a light-emitting element, a light-receiving element, and a detection hole. The detection hole is a through-hole provided to the gear train included in the first reduction mechanism 8. The light-emitting element and the light-receiving element face each other in the axial direction of the gear train of the first reduction mechanism 8, with the gear train interposed therebetween. The light-receiving element detects the light emitted from the light-emitting element and passed through the detection hole. The control circuit 20 acquires the position of the second hand 2 based on the detection result of the light-receiving element.

The control circuit 20 acquires the positions of the minute hand 3 and the hour hand 4 based on a detection result of the second detecting unit 16. The second detecting unit 16 has the same structure as that of the first detecting unit 15, for example. The detection hole of the second detecting unit 16 is provided to the gear train in the second reduction mechanism 9, for example. In such a configuration, the light-emitting element and the light-receiving element of the second detecting unit 16 are provided facing each other in the axial direction of the gear train of the second reduction mechanism 9, with the gear train interposed therebetween. The control circuit 20 acquires the positions of the minute hand 3 and the hour hand 4 based on the detection result of the light-receiving element included in the second detecting unit 16.

The control circuit 20 according to the embodiment has a power saving mode for reducing the power consumption in the electronic watch 1, as will be explained later. The power saving mode is a mode for suppressing the power consumption by stopping at least the second hand 2, among the second hand 2, the minute hand 3, and the hour hand 4. The power saving mode includes a first power saving mode PS1 and a second power saving mode PS2. The first power saving mode PS1 is a power saving mode for stopping the second hand 2 when the condition in which the power generating mechanism 21 is not generating power persists. The second power saving mode PS2 is a power saving mode for stopping the second hand 2 when the voltage of the battery 17 drops.

The control circuit 20 according to the embodiment executes a stopping operation when a predetermined transiting condition is satisfied while the mode is in a power saving mode. The stopping operation is an operation for stopping the power supply to the first driving circuit 13, the second driving circuit 14, and the control circuit 20. The execution of the stopping operation causes the electronic watch 1 to transit to a power break mode. In the power break mode, the power consumption of the electronic watch 1 is minimized, so that a reduction in the voltage of the battery 17 is suppressed.

A mode transition according to the embodiment will now be explained with reference to FIG. 5. FIG. 5 illustrates a mode transition while the operation unit 18 is at the zeroth step position. In this embodiment, the mode in which all of the second hand 2, the minute hand 3, and the hour hand 4 on the electronic watch 1 are moving will be referred to as a "normal mode".

First Power Saving Mode PS1

In the normal mode, the control circuit 20 monitors whether the power is being generated by the power generating mechanism 21. The control circuit 20 determines whether the power is being generated by the power generating mechanism 21 based on the value of a current flowing from the power generating mechanism 21 to the battery 17, for example. The control circuit 20 counts the time elapsed without any power being generated by the power generating mechanism 21 (hereinafter simply referred to as "no-power generating time"). When the no-power generating time becomes equal to or longer than a predetermined determination time T1, the control circuit 20 causes the electronic watch 1 to transit to the first power saving mode PS1, as indicated by the arrow Y1 in FIG. 5. The determination time T1 is 10 minutes, for example.

In the transition to the first power saving mode PS1, the control circuit 20 stops the second hand 2 at the first position. The first position according to the embodiment is the position of 12 o'clock. In other words, the first position of the second hand 2 is a position pointing to the power saving indicator 35, and the second hand 2 indicates that the mode has transited to the power saving mode because the no-power generating time has exceeded the predetermined determination time. The control circuit 20 causes the first driving circuit 13 to move the second hand 2 to the first position, and then stops the second hand 2 at the first position. The control circuit 20 may also stop the second hand 2 at the timing when the second hand 2 reaches the first position as a result of the ordinary movement. The control circuit 20 may also move the second hand 2 to the first position at a speed different from, or in a rotating direction different from that in the ordinary movement. For example, the control circuit 20 may rotate the second hand 2 to the first position at a rotation speed higher than that in the ordinary movement, and then stop the second hand 2 at the first position.

In the transition from the normal mode to the first power saving mode PS1, the control circuit 20 performs a hand position detection. The control circuit 20 may detect the position of the second hand 2 after stopping the second hand 2 at the first position, for example. If the detected position of the second hand 2 is displaced from the first position, the control circuit 20 corrects the position of the second hand 2. The control circuit 20 may also detect the position of the second hand 2 before stopping the second hand 2 at the first position. By detecting the actual position of the second hand 2, the control circuit 20 can stop the second hand 2 at the first position accurately.

Because the control circuit 20 according to the embodiment does not perform the hand position detection while the watch is in use in the normal mode, the control circuit 20 does not correct the positions even if an impact or the like applied from the external to the watch causes the hands to become displaced from the positions where the hands should be. If the transition to the first power saving mode PS1 takes place with the hands displaced, the second hand 2 falls incapable of pointing to the power saving indicator at the position of 12 o'clock. The user may then suspect that a failure of the watch occurred. For this reason, the control circuit 20 performs the hand position detection before or after the transition to the first power saving mode PS1 takes place, and corrects the position of the hand so that the hand can point to the power saving indicator accurately.

The control circuit 20 then monitors whether the power is being generated by the power generating mechanism 21 in the first power saving mode PS1. If the power generating mechanism 21 is detected to be generating power, the control circuit 20 counts the power generating time. The power generating time is kept being counted while the power is kept being generated by the power generating mechanism 21, and is reset when the generation of power ceases to be detected. In other words, in the first power saving mode PS1, the control circuit 20 counts the time by which the power generating mechanism 21 keeps generating power. The electronic watch 1 according to the embodiment reduces the frequency of the clock of the counter 19 in the first power saving mode PS1 or the second power saving mode PS2, compared with that used in the normal mode. For example, the clock frequency used in the power saving modes PS1, PS2 may be 1/10 the clock frequency used in the normal mode. In this manner, the counter does not need to be increased even if the power generating time or the no-power generating time becomes extended, so that the circuit scale can be reduced, and the current consumption can be suppressed.

Furthermore, because the duration with which the power generation is determined is shorter than that with which the no-power generation is determined, it is also possible to use the clock frequency of the normal mode to measure the power generating time, and to use 1/10 the clock frequency of the normal mode to measure the no-power generating time. In this manner, it is possible to measure the power generating time at a higher resolution, so that an accurate time measurement can be achieved. The number of divisions 1/10 of the clock frequency explained above is exemplary, and the present embodiment is not limited thereto.

When the power generating time becomes equal to or longer than a predetermined third determination time P3, the control circuit 20 causes the electronic watch 1 to resume from the first power saving mode PS1 to the normal mode, as indicated by the arrow Y2 in FIG. 5. This third determination time P3 is 5 seconds, for example.

Once the mode is resumed from the first power saving mode PS1 to the normal mode, the control circuit 20 starts moving the second hand 2 again. At this time, the control circuit 20 may start moving the second hand 2 at the timing at which the position of the second hand 2 corresponding to the internal time comes to the first position. Alternatively, the control circuit 20 may start the ordinary movement of the second hand 2 after moving the second hand 2 to the position corresponding to the internal time.

In the transition from the first power saving mode PS1 to the normal mode, the control circuit 20 performs the hand position detection. The control circuit 20 detects the position of the second hand 2 after starting to rotate the second hand 2, for example. If the detected position of the second hand 2 is displaced from the position corresponding to the internal time, the control circuit 20 can cause the first driving circuit 13 to correct the position of the second hand 2. Under conditions in which such a displacement of the hand is less likely to occur, it is not always necessary to perform this hand position detection in the transition from the first power saving mode PS1 to the normal mode. For example, if the watch resumes to the normal mode shortly after having transited from the normal mode to the first power saving mode PS1, it is not necessary to perform this hand position detection, because it is less likely for the hand to have become displaced.

Furthermore, the hand position detection consumes power, because the optical element is caused to emit light while the motor is moved to rotate the gears that are meshed with the hands. Therefore, the hand position detection performed every time the mode transition takes place may be partly omitted, based on the balance between the power generated and the power spent, and on the likeliness of the hand becoming displaced.

In the first power saving mode PS1, the control circuit 20 counts the duration of the first power saving mode PS1. If a first determination time P1 elapses without satisfying the condition for resuming to the normal mode from the first power saving mode PS1, the control circuit 20 executes a first stopping operation. The first determination time P1 is 1 month, for example. The duration of the first power saving mode PS1 may be reset when the power generating mechanism 21 is detected to be generating power. Once the power generation then ceases to be detected, the control circuit 20 starts counting the duration again. In the first power saving mode PS1, it is also possible to configure the control circuit 20 to execute the first stopping operation when the first determination time P1 becomes equal to or longer than the no-power generating time.

The first stopping operation is an operation for stopping supplying power to the control circuit 20, the first driving circuit 13, and the second driving circuit 14. The control circuit 20 outputs a command signal for stopping the power supply to the control circuit 20, the first driving circuit 13, and the second driving circuit 14, for example, to a power supply circuit including the battery 17. In response to the command signal, the power supply to the control circuit 20, the first driving circuit 13, and the second driving circuit 14 is stopped.

First Power Break Mode PB1

The control circuit 20 the power supply to which is stopped stops operations including calculation of the internal time. Furthermore, because the power supply to the first driving circuit 13 and the second driving circuit 14 is stopped, the movements of the second hand 2, the minute hand 3, and the hour hand 4 are also stopped. The second hand 2 remains at the first position. The minute hand 3 and the hour hand 4 stop at where these hands are positioned when the power supply is stopped. The execution of the first stopping operation causes the electronic watch 1 to transit to the first power break mode PB1, as indicated by the arrow Y3 in FIG. 5. The first power break mode PB1 is a power break mode applied when a first stop condition is satisfied. The first stop condition is satisfied when the first determination time P1 elapses without any power generated by the power generating mechanism 21.

When the power becomes generated by the power generating mechanism 21 in the first power break mode PB1, the electronic watch 1 starts counting the power generating time. The electronic watch 1 according to the embodiment includes a starting circuit that starts the control circuit 20 when the power becomes generated by the power generating mechanism 21. The control circuit 20 having started counts the duration by which the power generating mechanism 21 continues generating power. This power generating time is kept counted while the power generating mechanism 21 keeps generating power, and is reset when the power generation ceases to be detected. If a predetermined time elapses without any power generation by the power generating mechanism 21, the power supply to the control circuit 20 is stopped.

When a condition for resuming from the first power break mode PB1 to the normal mode is satisfied, the control circuit 20 causes the electronic watch 1 to transit to the normal mode, as indicated by the arrow Y4 in FIG. 5. The condition for resuming from the first power break mode PB1 to the normal mode is satisfied if the power generating time becomes equal to or longer than a predetermined determination time T2, and if the voltage of the battery 17 is equal to or higher than a first voltage V1. The first voltage V1 is higher than a lower-boundary voltage VL that is described later. The determination time T2 is 5 seconds, for example.

If the condition for resuming from the first power break mode PB1 to the normal mode is satisfied, the control circuit 20 starts moving the second hand 2, the minute hand 3, and the hour hand 4, again. Specifically, the control circuit 20 starts causing the battery 17 to supply power to the first driving circuit 13 and the second driving circuit 14. The control circuit 20 causes the first driving circuit 13 to start moving the second hand 2 from the position where the second hand 2 has been in the first power break mode PB1. The control circuit 20 also causes the second driving circuit 14 to start moving the minute hand 3 and the hour hand 4 again, from the positions where the minute hand 3 and the hour hand 4 have been in the first power break mode PB1.

Second Power Saving Mode PS2

In the normal mode, the control circuit 20 monitors the voltage of the battery 17. If the voltage of the battery 17 becomes equal to or lower than a predetermined lower-boundary voltage VL, the control circuit 20 causes the electronic watch 1 to transit to the second power saving mode PS2, as indicated by the arrow Y5 in FIG. 5.

In the transition to the second power saving mode PS2, the control circuit 20 stops the second hand 2 at a second position. The second position according to the embodiment is the position of 4 o'clock. In other words, the second position of the second hand 2 is the position where the second hand 2 points to the charge warning indicator 36. The control circuit 20 causes the first driving circuit 13 to move the second hand 2 to the second position, and to stop the second hand 2. The control circuit 20 may also stop the second hand 2 at the timing the second hand 2 reaches the second position as a result of the ordinary movement. The control circuit 20 may also move the second hand 2 at a speed different from, or in a rotating direction different from that in the ordinary movement. For example, the control circuit 20 may rotate the second hand 2 to the second position at a rotation speed higher than that in the ordinary movement, and stop the second hand 2.

In the transition from the normal mode to the second power saving mode PS2, the control circuit 20 performs the hand position detection. The control circuit 20 may detect the position of the second hand 2 after stopping the second hand 2 at the second position, for example. If the detected position of the second hand 2 is displaced from the second position, the control circuit 20 corrects the position of the second hand 2. The control circuit 20 may also detect the position of the second hand 2 before stopping the second hand 2 at the second position. By detecting the actual position of the second hand 2, the control circuit 20 can stop the second hand 2 at the second position accurately.

In the second power saving mode PS2, the control circuit 20 monitors whether the power is being generated by the power generating mechanism 21. If the power generating mechanism 21 is detected to be generating power, the control circuit 20 counts the power generating time. The power generating time counted in the second power saving mode PS2 is a cumulative power generating time. The control circuit 20 counts the cumulative power generating time while the power generating mechanism 21 is detected to be generating power.

The control circuit 20 counts the carry-up signal being output from the counter 19. In the second power saving mode PS2, the counter 19 outputs the carry-up signal at an interval longer than that used in the normal mode. For example, in the second power saving mode PS2, the counter 19 outputs the carry-up signal at an interval of 1 second. By counting the carry-up signal being output from the counter 19, the control circuit 20 calculates the cumulative power generating time. The counter 19 according to the embodiment is configured to output a carry-up signal at the timing when the control circuit 20 wakes up. For example, the control circuit 20 wakes up at the timing at which the oscillation of the reference clock is adjusted using the theoretical regulation, and goes to sleep upon completions of the adjustment of the reference clock oscillation frequency using the theoretical regulation and counting of the cumulative power generating time. The cumulative power generating time is reset when a predetermined period elapses from when the counting of the power generating time is started. In other words, the control circuit 20 calculates the cumulative power generating time within the predetermined period. The predetermined period is 1 day, for example.

If the cumulative power generating time becomes equal to or longer than a fourth determination time P4, the control circuit 20 causes the electronic watch 1 to resume to the normal mode, as indicated by the arrow Y6 in FIG. 5. The fourth determination time P4 is longer than the third determination time P3. The fourth determination time P4 is 5 minutes, for example. The fourth determination time P4 is set in such a manner that the voltage of the battery 17 can be appropriately increased, for example. The fourth determination time P4 is defined based on the capacity of the battery 17, the generating capacity of the power generating mechanism 21, and the like.

In this embodiment, based on the cumulative power generating time, a determination as to whether to resume to the normal mode is made appropriately. Although the voltage of the battery 17 may be used in determining whether to resume to the normal mode, the voltage of the battery 17 surges temporarily when the power is stored in the battery 17, due to the polarization effect, for example. In such a case, despite the remaining charge of the battery 17 may not be sufficiently recovered, a determination as to whether to resume to the normal mode may be made based on the instantaneous voltage. Such an operation may lead to frequent and repetitive mode transitions between the normal mode and the second power saving mode PS2. According to the embodiment, because the determination is made based on the cumulative power generating time, the recovered amount of charge in the battery 17 can be recognized accurately even when there is a fluctuation or a drop in the voltage of the generated power within a short time period, by measuring the cumulative power generating time. In this manner, the determination as to whether to resume is made after the remaining charge of the battery 17 has been recovered appropriately.

In resuming from the second power saving mode PS2 to the normal mode, the control circuit 20 starts moving the second hand 2 again. At this time, the control circuit 20 may start the movement of the second hand 2 at the timing at which the position of the second hand 2 corresponding to the internal time reaches the second position. Alternatively, the control circuit 20 may move the second hand 2 to position corresponding to the internal time, and then start the ordinary movement of the second hand 2.

In the transition from the second power saving mode PS2 to the normal mode, the control circuit 20 performs the hand position detection. The control circuit 20 detects the position of the second hand 2 after starting to rotate the second hand 2, for example. If the detected position of the second hand 2 is displaced from the position corresponding to the internal time, the control circuit 20 can cause the first driving circuit 13 to correct the position of the second hand 2. Under conditions in which such a displacement of the hand is less likely to occur, it is not always necessary to perform this hand position detection in the transition from the second power saving mode PS2 to the normal mode. For example, if the watch resumes to the normal mode shortly after having transited from the normal mode to the second power saving mode PS2, it is not necessary to perform this hand position detection, because it is less likely for the hand to be displaced.

If a second determination time P2 elapses without satisfying the condition for resuming from the second power saving mode PS2 to the normal mode, the control circuit 20 executes a second stopping operation. The second stopping operation is an operation for stopping supplying power to the control circuit 20, the first driving circuit 13, and the second driving circuit 14. The control circuit 20 outputs a command signal for stopping the power supply to the control circuit 20, the first driving circuit 13, and the second driving circuit 14, for example, to the power supply circuit including the battery 17. In response to the command signal, the power supply to the control circuit 20, the first driving circuit 13, and the second driving circuit 14 is stopped. The second determination time P2 is shorter than the first determination time P1. The second determination time P2 is 3 days, for example.

The control circuit 20 the power supply to which is stopped stops operations including calculation of the internal time. Furthermore, because the power supply to the first driving circuit 13 and the second driving circuit 14 is stopped, the movements of the second hand 2, the minute hand 3, and the hour hand 4 also stop. The second hand 2 remains at the second position. The minute hand 3 and the hour hand 4 stop at where these hands are positioned when the power supply is stopped. The execution of the second stopping operation causes the electronic watch 1 to transit to a second power break mode PB2, as indicated by the arrow Y7 in FIG. 5. The second power break mode PB2 is a power break mode applied when a second stop condition is satisfied. The second stop condition is satisfied when the second determination time P2 elapses without the cumulative power generating time becoming equal to or longer than the fourth determination time P4. The second stop condition may be satisfied when the no-power generating time becomes equal to or longer than the second determination time P2.

If the power becomes generated by the power generating mechanism 21 in the second power break mode PB2, the electronic watch 1 acquires the voltage of the battery 17. The electronic watch 1 according to the embodiment includes a starting circuit that starts the control circuit 20 when the power becomes generated by the power generating mechanism 21. The control circuit 20 having started acquires the voltage of the battery 17. If the voltage of the battery 17 is stably sustained at a level equal to or higher than the first voltage V1, the control circuit 20 causes the electronic watch 1 to transit to the normal mode, as indicated by the arrow Y8 in FIG. 5.

The control circuit 20 determines that the condition for resuming from the second power break mode PB2 to the normal mode is satisfied if the voltage of the battery 17 is sustained to a level equal to or higher than the first voltage V1 over a period equal to or longer than a predetermined time, for example. The predetermined time is preferably a few minutes or longer, and is 5 minutes, for example. The predetermined time is defined in such a manner that a determination as to whether to resume can be made without being affected by a temporary voltage surge resultant of the polarization effect. According to the embodiment, even if the voltage of the battery 17 surges temporarily due to the polarization effect, the condition for resuming to the normal mode is not satisfied immediately. Therefore, the determination as to whether to resume to the normal mode is made appropriately.

If the condition for resuming from the second power break mode PB2 to the normal mode is satisfied, the control circuit 20 starts moving the second hand 2, the minute hand 3, and the hour hand 4 again. Specifically, the control circuit 20 causes the first driving circuit 13 to start moving the second hand 2 again. The first driving circuit 13 starts moving the second hand 2 from the position where the second hand 2 has been in the second power break mode PB2. The control circuit 20 causes the second driving circuit 14 to move the minute hand 3 and the hour hand 4 again. The second driving circuit 14 starts moving the minute hand 3 and the hour hand 4 again, from the position where the minute hand 3 and the hour hand 4 have been in the second power break mode PB2.

If the voltage of the battery 17 drops in the first power saving mode PS1, the control circuit 20 causes the electronic watch 1 to transit to the second power saving mode PS2, as indicated by the arrow Y9 in FIG. 5. For example, if the voltage of the battery 17 reaches the lower-boundary voltage VL, the control circuit 20 causes the electronic watch 1 to transit to the second power saving mode PS2. In such a case, the control circuit 20 moves the second hand 2 from the first position to the second position, and stops the second hand 2.

While the first power break mode PB1 and the second power break mode PB2 are both a power break mode, because the control circuit 20 retains information as to which transition the mode has followed, i.e., the arrow Y3 or the arrow Y7, to arrive at the power break, the control circuit 20 can select which one of the condition is to be used in determining as to whether to resume to the normal mode, i.e., the condition corresponding to the arrow Y4 or that corresponding to the arrow Y8.

The condition for transiting to the normal mode from the first power saving mode PS1, indicated by the arrow Y2 in FIG. 5, may be based on the cumulative power generating time, and the condition for transiting from the second power saving mode PS2 to the normal mode, indicated by the arrow Y6 in FIG. 5, may be based on a continuous power generating time. Even when such conditions are to be used, the fourth determination time P4 remains longer than the third determination time P3.

In the normal mode, if the operation unit 18 is pulled and moved from the zeroth step position to the first step position, the control circuit 20 causes the electronic watch 1 to transit to the time correction mode, as indicated by the arrow Y10 in FIG. 5. In the time correction mode, the control circuit 20 causes the first driving circuit 13 to stop the second hand 2. The position at which the second hand 2 is stopped is the position where the second hand 2 has been at the time of transition to the time correction mode. In other words, in the transition from the normal mode to the time correction mode, the second hand 2 is stopped at some position. Furthermore, the rotations of the minute hand 3 and the hour hand 4 are mechanically restricted. In the time correction mode, by rotating the operation unit 18, a user can cause the minute hand 3 and the hour hand 4 to rotate, and to correct the indicated time. In the time correction mode, the control circuit 20 may stop the operation of the second driving circuit 14. In the time correction mode, the internal time is reset.

In the time correction mode, if the position of the operation unit 18 is changed from the first step position to the zeroth step position, the control circuit 20 causes the electronic watch 1 to transit to the normal mode, as indicated by the arrow Y11 in FIG. 5. The control circuit 20 starts moving the second hand 2, the minute hand 3, and the hour hand 4 again in the normal mode. At the timing of transition from the time correction mode to the normal mode, the control circuit 20 performs the hand position detection. The control circuit 20 detects the positions of the second hand 2, the minute hand 3, and the hour hand 4, respectively. The control circuit 20 then sets the internal time based on the detected hand positions.

The first stopping operation and the second stopping operation performed in the time correction mode will now be explained with reference to FIG. 6. FIG. 6 illustrates a mode transition with the operation unit 18 at the first step position. In the time correction mode, the movement of the second hand 2 has been stopped. In other words, the time correction mode can be said to be a type of power saving mode in which the second hand 2 is not driven to move.

First Power Break Mode PB1

In the time correction mode, the control circuit 20 counts the time elapsed from the start of the time correction mode. If the time elapses from the start of the time correction mode becomes equal to or longer than the determination time T3, the control circuit 20 causes the electronic watch 1 to transit to the first power break mode PB1 (first stopping operation), as indicated by the arrow Y21 in FIG. 6. The determination time T3 is shorter than the first determination time P1 that is the threshold value for determining whether to transit from the first power saving mode PS1 to the first power break mode PB1. The determination time T3 is 1 day, for example. The control circuit 20 in the time correction mode may also perform the first stopping operation when the no-power generating time becomes equal to or longer than the determination time T3.

A possible example in which the time correction mode persists for an extended length of time includes a situation in which a user has forgotten to bring back the operation unit 18 to the zeroth step position before storing the electronic watch 1, for example. Another example includes a situation in which the electronic watch 1 is kept in a storage, with its mode set to the time correction mode, in order to suppress the consumption of the battery 17. In these situations, the electronic watch 1 is caused to transit to the first power break mode PB1 automatically, so that the voltage drop in the battery 17 is suppressed effectively.

In the transition to the first power break mode PB1, the control circuit 20 moves the second hand 2 to the first position, and stops the second hand 2 at the first position. When the transition is from the time correction mode to the first power break mode PB1, the control circuit 20 performs the hand position detection. The control circuit 20 detects the position of the second hand 2 after starting to rotate the second hand 2, for example. Based on the detected position of the second hand 2, the control circuit 20 calculates the target amount of rotation from the current position to the first position of the second hand 2. The control circuit 20 causes the first driving circuit 13 to move the second hand 2 to the first position, based on the target amount of rotation. The control circuit 20 may perform this hand position detection after stopping the second hand 2 at the first position. After stopping the second hand 2 at the first position, the control circuit 20 stops the power supply to the control circuit 20, the first driving circuit 13, and the second driving circuit 14.

When the power becomes generated by the power generating mechanism 21 in the first power break mode PB1, the electronic watch 1 starts counting the power generating time. The power generating time is kept counted while the power generating mechanism 21 keeps generating power, and is reset when generation of power ceases to be detected. If a condition for resuming from the first power break mode PB1 to the time correction mode is satisfied, the control circuit 20 causes the electronic watch 1 to transit to the time correction mode, as indicated by the arrow Y22 in FIG. 6. The condition for resuming from the first power break mode PB1 to the time correction mode is satisfied when the power generating time becomes equal to or longer than a predetermined determination time T4, and the voltage of the battery 17 becomes equal to or higher than the first voltage V1. The determination time T4 is 5 seconds, for example.

Charge Warning Mode

In the time correction mode, the control circuit 20 monitors the voltage of the battery 17. If the voltage of the battery 17 drops to a level equal to or lower than the lower-boundary voltage VL, the control circuit 20 causes the electronic watch 1 to transit to a charge warning mode WNG, as indicated by the arrow Y23 in FIG. 6. The charge warning mode WNG is a mode for giving a warning to the user or the like, that the voltage of the battery 17 has dropped.

In the transition from the time correction mode to the charge warning mode WNG, the control circuit 20 moves the second hand 2 to the second position, and stops the second hand 2 at the second position. In the transition from the time correction mode to the charge warning mode WNG, the control circuit 20 performs the hand position detection. The control circuit 20 detects the position of the second hand 2 after starting to rotate the second hand 2, for example. Based on the detected position of the second hand 2, the control circuit 20 calculates the target amount of rotation from the current position to the second position of the second hand 2. The control circuit 20 causes the first driving circuit 13 to move the second hand 2 to the second position, based on the target amount of rotation. The hand position may be detected after stopping the second hand 2 at the second position.

In the charge warning mode WNG, the control circuit 20 monitors whether the power is being generated by the power generating mechanism 21. If the power generating mechanism 21 is detected to be generating power, the control circuit 20 counts the power generating time. The power generating time counted in the charge warning mode WNG is the cumulative power generating time. The control circuit 20 counts the cumulative power generating time every time the power generating mechanism 21 is detected to be generating power. The cumulative power generating time is reset when a predetermined period elapses from when the control circuit 20 starts counting the power generating time. In other words, the control circuit 20 calculates the cumulative power generating time within the predetermined period. The predetermined period is 1 day, for example. The electronic watch 1 is configured to resume from the charge warning mode WNG to the time correction mode based on the cumulative power generating time. By measuring the cumulative power generating time, the amount of charge recovered in the battery 17 can be recognized accurately, even when there is a fluctuation or a drop in the voltage of the generated power within a short time period. Therefore, the remaining charge of the battery 17 is recovered appropriately before the determination as to whether to resume is made.

If the cumulative power generating time becomes equal to or longer than a determination time T5, the control circuit 20 causes the electronic watch 1 to resume to the time correction mode, as indicated by the arrow Y24 in FIG. 6. The length of the determination time T5 is the same as the length of the fourth determination time P4, and is 5 minutes, for example. In resuming to the time correction mode, the control circuit 20 may also move the second hand 2 to a position different from the second position. For example, the control circuit 20 moves the second hand 2 to a position that is different from the first position and the second position. By changing the position of the second hand 2 to a position different from the second position, a user can recognize that the voltage of the battery 17 has been recovered. For example, the control circuit 20 may bring the second hand 2 back to the original position before the transition to the charge warning mode WNG has taken place.

If the operation unit 18 is at the zeroth step position when the electronic watch 1 resumes to the time correction mode, the control circuit 20 causes the electronic watch 1 to transit from the time correction mode to the normal mode. As a result of this transition to the normal mode, the second hand 2, the minute hand 3, and the hour hand 4 start moving again.

In the charge warning mode WNG, the control circuit 20 counts the time elapsed from the start of the charge warning mode WNG. If the time elapsed from the start of the charge warning mode WNG becomes equal to or longer than a determination time T6, the control circuit 20 causes the electronic watch 1 to transit to the second power break mode PB2, as indicated by the arrow Y25 in FIG. 6. The determination time T6 is 3 days, for example. Because a relatively long time is set as the determination time T6, the user is further allowed to notice that the voltage of the battery 17 has dropped.

In the transition to the second power break mode PB2, the control circuit 20 stops the power supply to the control circuit 20, the first driving circuit 13, and the second driving circuit 14 with the second hand 2 kept at the second position. By causing the electronic watch 1 to transit to the second power break mode PB2, the consumption of the battery 17 is suppressed proactively.

If the power becomes generated by the power generating mechanism 21 in the second power break mode PB2, the electronic watch 1 acquires the voltage of the battery 17. If the power becomes generated by the power generating mechanism 21, the starting circuit starts the control circuit 20. The control circuit 20 having started acquires the voltage of the battery 17. If the voltage of the battery 17 is stably sustained at a level equal to or higher than the first voltage V1, the control circuit 20 causes the electronic watch 1 to transit to the time correction mode, as indicated by the arrow Y26 in FIG. 6. The control circuit 20 determines that the condition for resuming from the second power break mode PB2 to the time correction mode is satisfied if the voltage of the battery 17 is sustained at a level equal to or higher than the first voltage V1 for 5 minutes or longer, for example.

As explained above, the electronic watch 1 according to the embodiment includes, as an example, the power generating mechanism 21, the battery 17, the hands including the second hand 2, the electrostatic motor 11 and the electromagnetic motor 12 that cause the hands to rotate, the first driving circuit 13 and the second driving circuit 14, and the control circuit 20. The battery 17 is charged by the power generated by the power generating mechanism 21. The hands include the second hand 2, the minute hand 3, and the hour hand 4. The first driving circuit 13 and the second driving circuit 14 drive the electrostatic motor 11 and the electromagnetic motor 12 using the power supplied by the battery 17. The control circuit 20 controls the first driving circuit 13 and the second driving circuit 14.

The control circuit 20 executes the first stopping operation for stopping the first driving circuit 13, the second driving circuit 14, and the control circuit 20 in a power saving mode for suppressing power consumption, and when the first determination time P1 elapses without any power being generated by the power generating mechanism 21. The control circuit 20 executes the second stopping operation for stopping the first driving circuit 13, the second driving circuit 14, and the control circuit 20 in a power saving mode for suppressing power consumption, when the second determination time P2 elapses, and the voltage of the battery 17 remains lower than lower-boundary voltage VL. As means for stopping the first driving circuit 13, the second driving circuit 14, and the control circuit 20, the power supply to the circuits 13, 14, 20 is stopped, for example. The control circuit 20 may also reduce the power consumption by stopping at least a part of, or preferably most of the functions of the circuits 13, 14, 20.

The electronic watch 1 according to the embodiment executes the first stopping operation based on the no-power generating time, and executes the second stopping operation based on the voltage of the battery 17. In this manner, by executing the first stopping operation based on the condition of no power generation, and executing the second stopping operation based on a voltage drop, it is possible to extend the operating time of the electronic watch 1.

In the power saving modes PS1 and PS2 according to the embodiment, at least the second hand 2 among the hands is caused to stop to suppress power consumption. By stopping at least the second hand 2 in the power saving mode, the power consumption is suppressed. By executing the first stopping operation and the second stopping operation in the power saving mode, further power saving can be achieved.

The power saving mode according to the embodiment includes the first power saving mode PS1 and the second power saving mode PS2. The first power saving mode PS1 is a power saving mode for stopping the second hand 2 when a condition without any power generation by the power generating mechanism 21 persists. The second power saving mode PS2 is a power saving mode for stopping the second hand 2 when the voltage of the battery 17 drops. With these two power saving modes PS1, PS2, effective power saving can be achieved.

The second determination time P2 in the second power saving mode PS2 is shorter than the first determination time P1 in the first power saving mode PS1. By executing the stopping operation with the shorter determination time in case of a voltage drop in the battery 17, power can be saved effectively.

The control circuit 20 according to the embodiment stops the second hand 2 at the first position in the first power saving mode PS1, and stops the second hand 2 at the second position in the second power saving mode PS2. The second position is a position different from the first position. By changing the position where the second hand 2 is stopped depending on the power saving modes PS1, PS2, a user can visually recognize the status of the electronic watch 1 easily.

When executing the first stopping operation in the first power saving mode PS1, the control circuit 20 according to the embodiment stops the first driving circuit 13, the second driving circuit 14, and the control circuit 20 with the second hand 2 kept at the first position. When executing the second stopping operation in the second power saving mode PS2, the control circuit 20 stops the first driving circuit 13, the second driving circuit 14, and the control circuit 20 with the second hand 2 kept at the second position. Because the second hand 2 is kept at different positions, a user can visually recognize the status of the electronic watch 1 easily.

When the voltage of the battery 17 drops in the first power saving mode PS1, the control circuit 20 according to the embodiment causes the mode to transit to the second power saving mode PS2. In this manner, a voltage drop in the battery 17 is suppressed effectively.

When the power generating time of the power generating mechanism 21 in the first power saving mode PS1 becomes equal to or longer than the third determination time P3, the control circuit 20 according to the embodiment starts moving the second hand 2, and when the power generating time of the power generating mechanism 21 in the second power saving mode PS2 becomes equal to or longer than the fourth determination time P4, the control circuit 20 starts moving the second hand 2. The fourth determination time P4 is longer than the third determination time P3. Therefore, the voltage of the battery 17 is recovered appropriately before the second hand 2 is started to move.

In the first power saving mode PS1, the control circuit 20 according to the embodiment determines whether to resume to the normal mode and to start moving the second hand 2, based on the result of comparing a continuous power generating time of the power generating mechanism 21 with the third determination time P3. In the second power saving mode PS2, the control circuit 20 determines whether to resume to the normal mode and to start moving the second hand 2, based on the result of comparing the cumulative power generating time of the power generating mechanism 21, with the fourth determination time P4. By starting moving the second hand 2 based on the cumulative power generating time, the voltage of the battery 17 is recovered appropriately before the second hand 2 is started to move.

The control circuit 20 according to the embodiment executes the first stopping operation and the second stopping operation while the second hand 2 has been stopped by a user operation performed on the operation unit 18. As a result, the power consumption in the electronic watch 1 is suppressed, so that the operating time is extended.

The control circuit 20 according to the embodiment causes the first driving circuit 13 to stop the second hand 2 in response to an operation performed on the operation unit 18. If the voltage of the battery 17 drops to a level equal to or lower than the lower-boundary voltage VL while the second hand 2 is kept unmoved, the control circuit 20 rotates the second hand 2 to the warning position indicating a voltage drop in the battery 17, and stops the second hand 2 at the warning position. The warning position according to the embodiment is the second position. By stopping the second hand 2 at the warning position, a user can recognize that the voltage of the battery has dropped.

In this embodiment, conditions for restarting the operations of the first driving circuit 13, the second driving circuit 14, and the control circuit 20 in the power break modes PB1, PB2 include a condition for the voltage of the battery 17 to be higher than the lower-boundary voltage VL. In this embodiment, restart of the power supply is permitted if the voltage of the battery 17 is at a level equal to or higher than the first voltage V1. Because the movements of the hands are not started until the voltage of the battery 17 is recovered, the operating time of the electronic watch 1 is extended.

The control circuit 20 according to the embodiment performs the hand position detection in the transition from one mode to another mode. For example, the control circuit 20 detects the position of the second hand 2 in the transition from the normal mode to the power saving modes PS1, PS2. Because the position of the second hand 2 is detected, the control circuit 20 can stop the second hand 2 at a correct position. Furthermore, the control circuit 20 detects the position of the second hand 2 in resuming from the power saving modes PS1, PS2 to the normal mode. Because the position of the second hand 2 is detected, the control circuit 20 can bring the second hand 2 to a correct position that is based on the internal time.

The control circuit 20 may perform the hand position detection in the transition from the first power saving mode PS1 to the first power break mode PB1, or in the transition from the second power saving mode PS2 to the second power break mode PB2. The control circuit 20 may store the detected hand position in a non-volatile memory or the like.

Furthermore, the control circuit 20 may perform the hand position detection in the transition from the first power break mode PB1 to the normal mode, or in the transition from the second power break mode PB2 to the normal mode. In other words, the control circuit 20 may perform the hand position detection at the time of restarting the operations of the first driving circuit 13, the second driving circuit 14, and the control circuit 20. The electronic watch 1 may acquire the current time from external, via communication. The control circuit 20 may then correct the hand position in the transition from the power break modes PB1, PB2 to the normal mode based on the current time acquired from the external and on the detected hand position.

First Modification of Embodiment

A first modification of the embodiment will now be explained. The control circuit 20 may be configured to make the determination as to whether to resume from the second power saving mode PS2 to the normal mode (see the arrow Y6 in FIG. 5) based on the voltage of the battery 17. For example, if the voltage of the battery 17 is sustained at a level equal to or higher than the first voltage V1 for a predetermined time, the control circuit 20 may determine to resume to the normal mode. With this configuration, a processor circuit for accumulating time is rendered unnecessary, so that the area occupied by the circuitry can be reduced.

In the time correction mode, the control circuit 20 may transit the mode to the second power break mode PB2 not via the charge warning mode WNG when the voltage of the battery 17 drops. In this manner, no power is consumed in the charge warning mode WNG, so that the battery voltage is prevented from dropping further.

If no power is being generated by the power generating mechanism 21 in the time correction mode, the control circuit 20 may transit the electronic watch 1 to the first power saving mode PS1. In the transition to the first power saving mode PS1, the control circuit 20 moves the second hand 2 to the first position, and stops the second hand 2 at the first position. In this manner, the user can be informed that the operation unit 18 is at the first step position.

In the first power saving mode PS1 or the second power saving mode PS2, the minute hand 3 and the hour hand 4 may be stopped. In such a case, the control circuit 20 causes the second driving circuit 14 to retain the positions of the minute hand 3 and the hour hand 4 in the first power saving mode PS1 or the second power saving mode PS2. In this manner, the power consumption can be reduced further.

In determining whether to resume from the second power saving mode PS2 or the charge warning mode WNG, the control circuit 20 may make the determination based on the voltage of the battery 17, instead of the cumulative power generating time. For example, the control circuit 20 may cause the electronic watch 1 to transit to the normal mode or the time correction mode when the voltage of the battery 17 is sustained at a level equal to or higher than the first voltage V1 for a predetermined length of time. In this manner, the processor circuit for accumulating time is rendered unnecessary, and the area occupied by the circuitry can be reduced.

Second Modification of Embodiment

Figure 7:
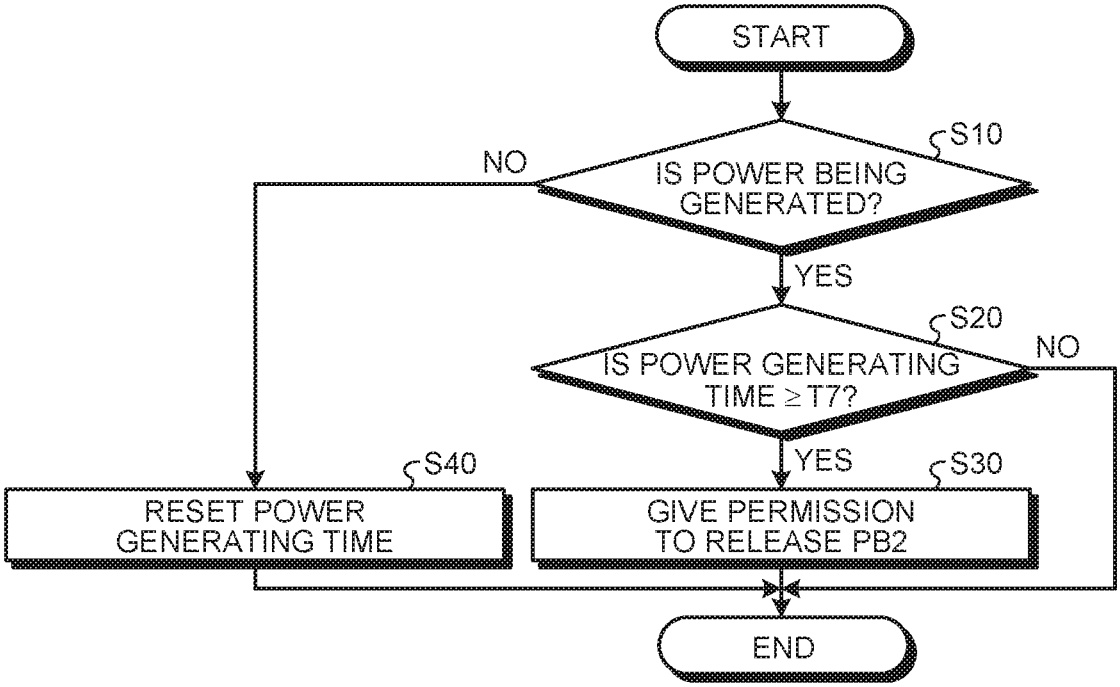
FIG. 7 is a flowchart according to a second modification of the embodiment.
Figure 8:
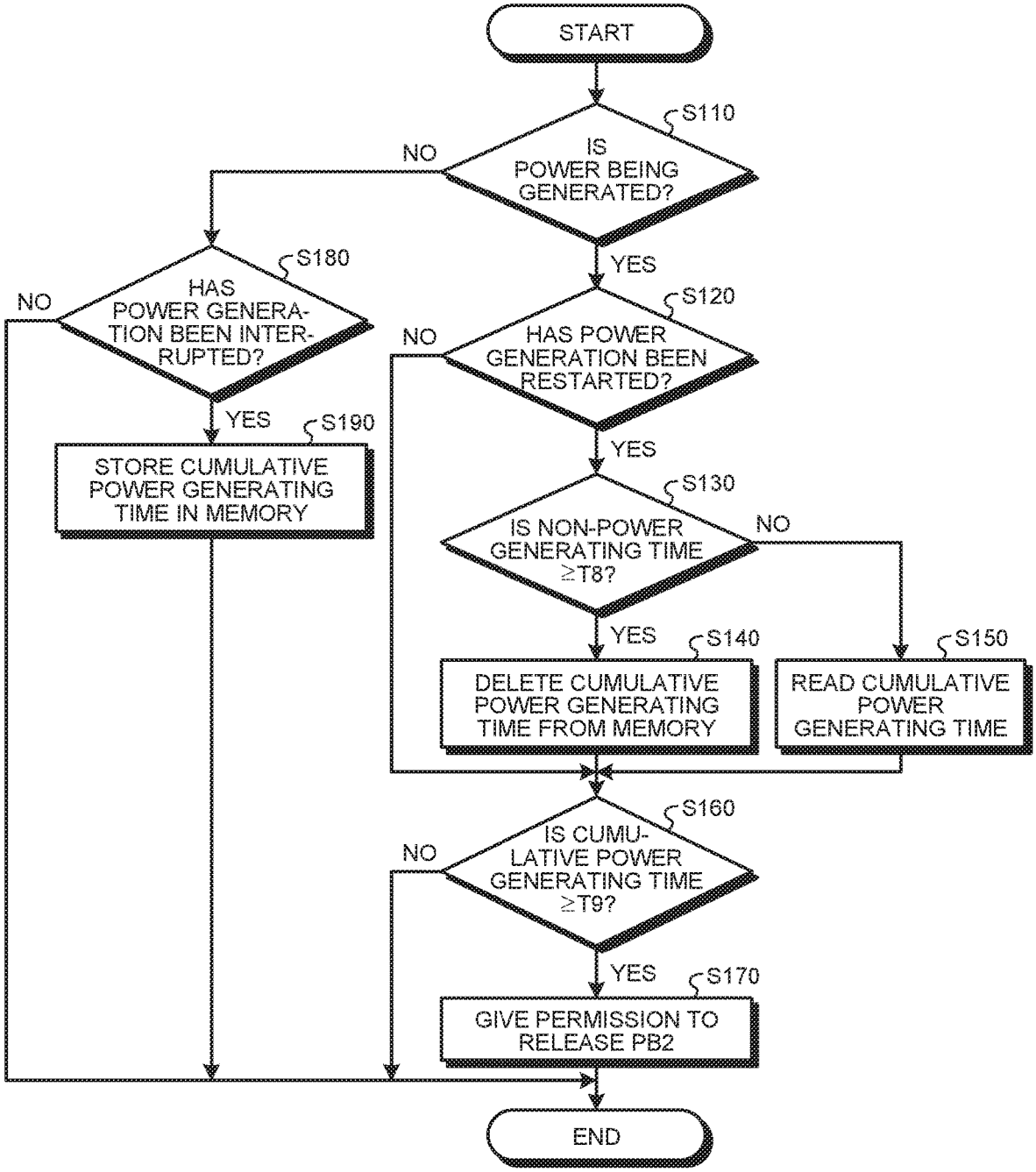
FIG. 8 is another flowchart according to the second modification of the embodiment.

A second modification of the embodiment will now be explained. FIG. 7 is a flowchart according to the second modification of the embodiment, and FIG. 8 is another flowchart according to the second modification of the embodiment. The second modification of the embodiment is different from the embodiment described above in that, the determination as to whether to resume from the power break mode is made based on the amount of power generated, for example.

When used as the power generating mechanism 21 is a mechanism capable of generating a stable amount of power per unit time, as the electrostatic-induction power generating mechanism according to the embodiment is, the power generated by the power generating mechanism 21 while the user is moving generally remains constant. Therefore, the amount of power generated by the power generating mechanism 21 is substantially proportional to the power generating time of the power generating mechanism 21. In other words, the time by which the battery 17 is charged by the power generating mechanism 21 substantially represents the amount of charge in the battery 17. The control circuit 20 according to the second modification determines whether to resume from the second power break mode PB2 based on the power generating time of the power generating mechanism 21. In this manner, the control circuit 20 can evaluate the amount of charge in the battery 17 appropriately in determining whether to resume to the normal mode. Therefore, it becomes less likely for the electronic watch 1 to be caused to transit to the charge warning mode or the like within a short time period after resuming to the normal mode when the electronic watch 1 has been irradiated with light temporarily.

A method for determining whether to resume from the second power break mode PB2 in the second modification of the embodiment will now be explained with reference to FIG. 7. At Step S10, the control circuit 20 determines whether the power is being generated by the power generating mechanism 21. If a current flowing from the power generating mechanism 21 to the battery 17 is detected, for example, the control circuit 20 affirms the determination at Step S10. If the determination is affirmed at Step S10, the control is shifted to Step S20. If the determination is denied, the control is shifted to Step S40.

At Step S20, the control circuit 20 determines whether the power generating time is equal to or longer than the determination time T7. The power generating time is a continuous power generating time of the power generating mechanism 21, for example. The determination time T7 may be set as 5 minutes, for example. As a result of the determination at Step S20, if it is affirmed that the power generating time is equal to or longer than the determination time T7, the control is shifted to Step S30. If the determination is denied, this control sequence is ended. At Step S20, the determination may be based on a cumulative power generating time over a certain period ending at the current time, instead of a continuous power generating time, and is explained later in detail with reference to FIG. 8.

At Step S30, the control circuit 20 gives a permission to release the second power break mode PB2. For example, the control circuit 20 sets a flag indicating that a condition for resuming from second power break mode PB2 to the normal mode has been satisfied, to ON. If Step S30 is executed, this control sequence is ended.

At Step S40, the control circuit 20 resets the power generating time. As a result, when the power generating mechanism 21 starts power generation next time, the control circuit 20 starts counting the power generating time from zero. If Step S40 is executed, this control sequence is ended. According to the control sequence in FIG. 7, because the electronic watch 1 does not resume from the second power break mode PB2 to the normal mode unless the continuous power generating time of the power generating mechanism 21 reaches or exceeds a certain time period, the second power break mode PB2 is not released when the electronic watch 1 receives light temporarily, and therefore, the control sequence can contribute to power saving.

The determination as to whether to resume from the second power break mode PB2 may be set based on the cumulative power generating time in the power generating mechanism 21. The way in which a determination to resume is made based on the cumulative power generating time will now be explained with reference to FIG. 8. At Step S110, the control circuit 20 determines whether the power is being generated by the power generating mechanism 21. As a result of the determination at Step S110, if it is affirmed that the power is being generated, the control is shifted to Step S120. If it is denied, the control is shifted to Step S180.

At Step S120, the control circuit 20 determines whether the power generation has been restarted. The control circuit 20 affirms the determination at Step S120 if the power generation by the power generating mechanism 21 has been interrupted, and then restarted. When the power generation has been interrupted, as will be described later, the control circuit 20 according to the second modification stores the cumulative power generating time in a non-volatile memory (Step S190). The control circuit 20 affirms the determination at Step S120 if the determination is denied at Step S110 in the previous execution of this control sequence, and if the cumulative power generating time is stored in the non-volatile memory, for example. As a result of the determination at Step S120, if the control circuit 20 determines that the power generation has been restarted, the control is shifted to Step S130. If the determination is denied, the control is shifted to Step S160.

At Step S130, the control circuit 20 determines whether a non-power generating time is equal to or longer than a determination time T8. The non-power generating time is the length of a period in which the power generation by the power generating mechanism 21 has been interrupted. In other words, the non-power generating time is a time elapsed from when the previous power generation is ended to when the current power generation is started. The determination time T8 is 1 day, for example. As a result of the determination at Step S130, if it is affirmed that the non-power generating time is equal to or longer than the determination time T8, the control is shifted to Step S140. If the determination is denied, the control is shifted to Step S150.

At Step S140, the control circuit 20 deletes the cumulative power generating time from the memory. The control circuit 20 deletes the cumulative power generating time stored in the non-volatile memory, and resets the cumulative power generating time to zero. If Step S140 is executed, the control is shifted to Step S160.

At Step S150, the control circuit 20 reads the cumulative power generating time from the non-volatile memory. The control circuit 20 starts counting the cumulative power generating time using the cumulative power generating time read from the non-volatile memory as an initial value. The control circuit 20 counts the cumulative power generating time based on the signal output from the counter 19, for example. If Step S150 is executed, the control is shifted to Step S160.

At Step S160, the control circuit 20 determines whether the cumulative power generating time is equal to or longer than a determination time T9. The determination time T9 is 5 minutes, for example. As a result of the determination at Step S160, if it is affirmed that the power generating time is equal to or longer than the cumulative determination time T9, the control is shifted to Step S170. If the determination is denied, this control sequence is ended.

At Step S170, the control circuit 20 gives a permission to release the second power break mode PB2. If Step S170 is executed, this control sequence is ended.

At Step S180, the control circuit 20 determines whether the power generation has been interrupted. The control circuit 20 affirms the determination at Step S180 if the determination is affirmed at Step S110 in the previous execution of the control sequence, for example. As a result of the determination at Step S180, if it is determined that the power generation by the power generating mechanism 21 has been interrupted, the control is shifted to Step S190. If the determination is denied, this control sequence is ended.

At Step S190, the control circuit 20 stores the cumulative power generating time in the memory. The control circuit 20 stores the value of the current cumulative power generating time in the non-volatile memory. If Step S190 is executed, this control sequence is ended.

With the control sequence illustrated in FIG. 8, the cumulative power generating time is reset when the non-power generating time becomes equal to or longer than the determination time T8. In other words, if the power generation by the power generating mechanism 21 is interrupted over an extended time period, the cumulative power generating time starts being counted from zero. Therefore, according to the modification, the voltage of the battery 17 can be recovered to an appropriate level before the electronic watch 1 is resumed to the normal mode.

It is also possible not to reset the cumulative power generating time. In such a case, Step S130 and Step S140 may be omitted. In other words, the control sequence may be configured as: if the power generation is restarted (Yes at Step S120), the cumulative power generating time is read from the memory (Step S150), and the control is then shifted to Step S160.

As explained above, the electronic watch 1 according to the second modification of the embodiment releases the second power break mode PB2 based on the amount of power generated by the power generating mechanism 21 in the second power break mode PB2. In other words, when the driving circuits 13, 14 and the control circuit 20 have been stopped by the second stopping operation, the electronic watch 1 restarts the operations of the driving circuits 13, 14 and the control circuit 20 based on the amount of power generated by the power generating mechanism 21. In this modification, by determining whether to resume based on the power generating time, the determination to resume is made based substantially on the amount of power generated by the power generating mechanism 21.

Third Modification of Embodiment

Figure 9:
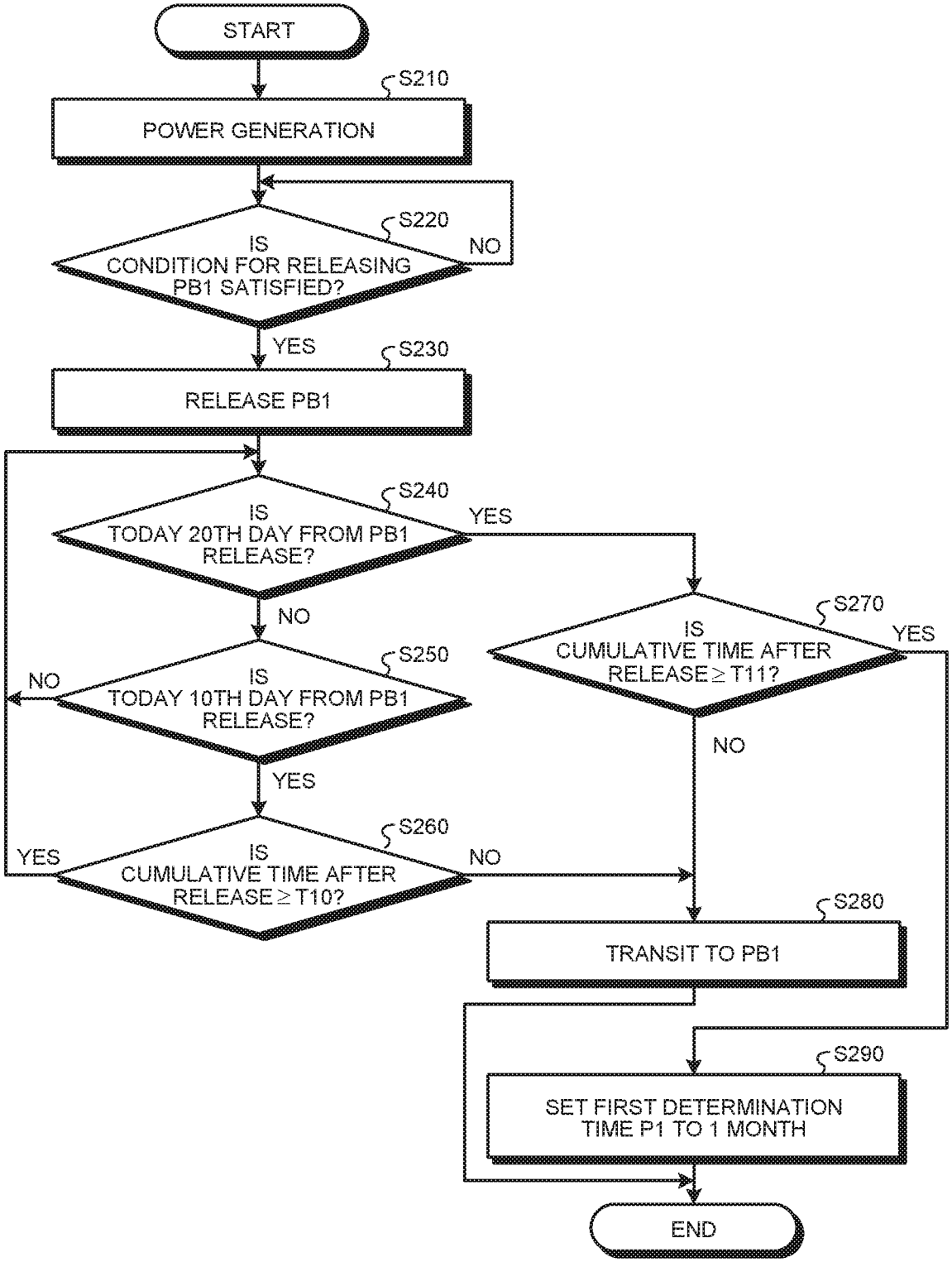
FIG. 9 is a flowchart according to a third modification of the embodiment.
Figure 10:
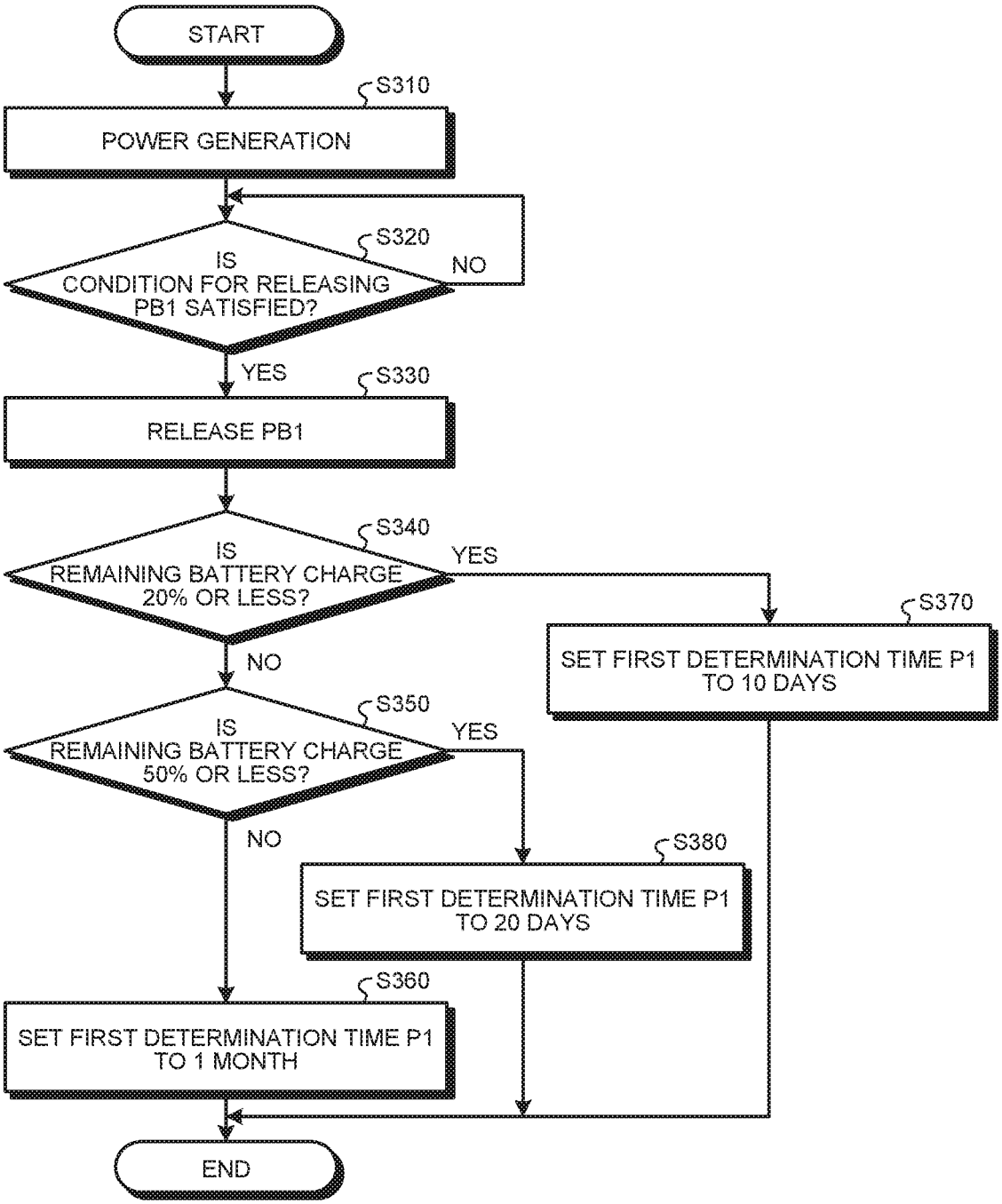
FIG. 10 is another flowchart according to the third modification of the embodiment.
Figure 11:
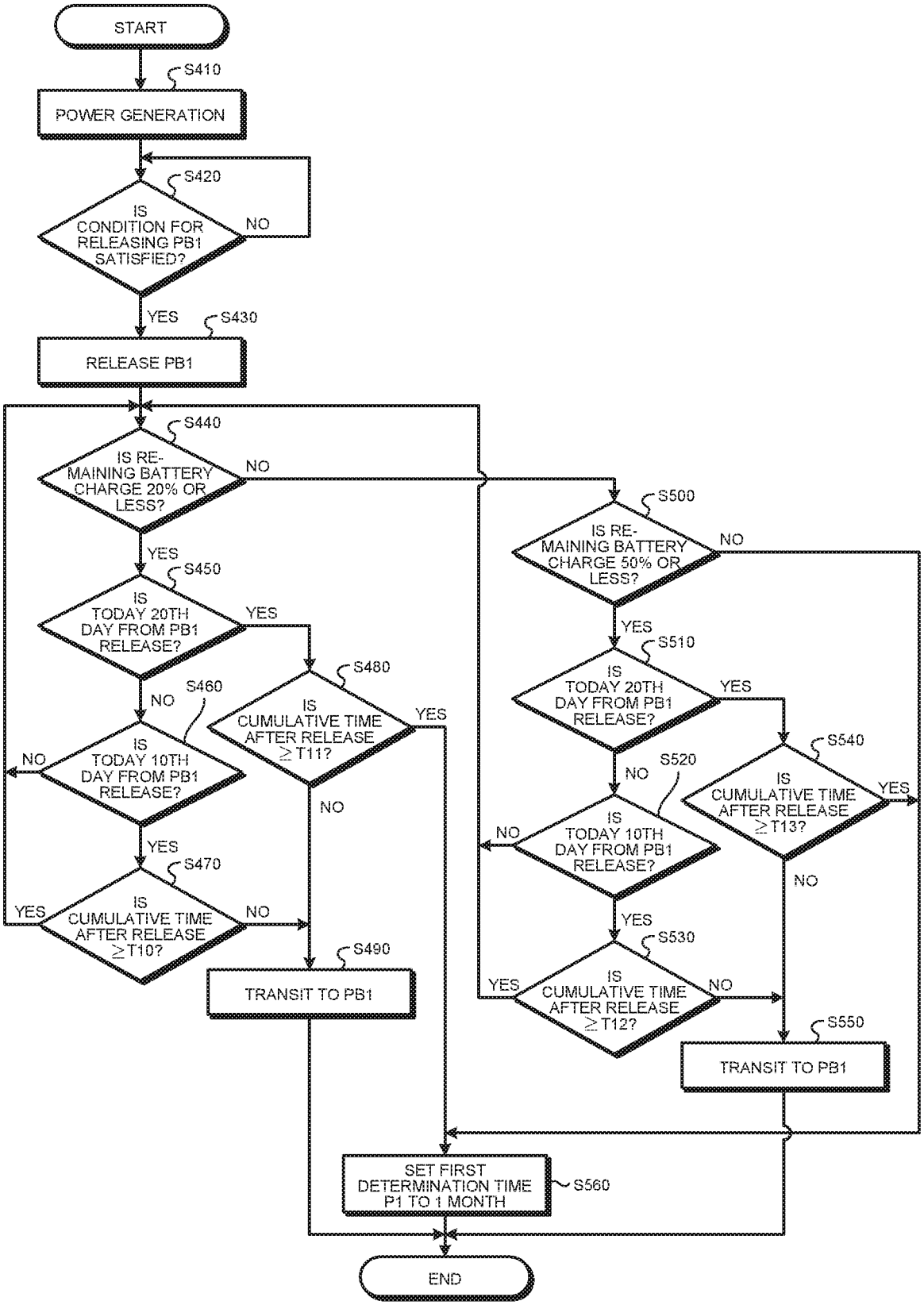
FIG. 11 is still another flowchart according to the third modification of the embodiment.

A third modification of the embodiment will now be explained. FIG. 9 is a flowchart according to the third modification of the embodiment. FIG. 10 is another flowchart according to the third modification of the embodiment, and FIG. 11 is still another flowchart according to the third modification of the embodiment. The third modification of the embodiment is different from the embodiment described above in that the condition for transiting to the first power break mode PB1 is changed based on the power generation status or the voltage of the battery 17, for example.

A method for determining the transiting condition based on the cumulative power generating time will now be explained with reference to FIG. 9. The control sequence illustrated in FIG. 9 is started in the first power break mode PB1, for example. At Step S210, the control sequence of the control circuit 20 is started when the power becomes generated by the power generating mechanism 21.

At next Step S220, the control circuit 20 determines whether a condition for releasing the first power break mode PB1 has been satisfied. The control circuit 20 affirms the determination at Step S220 if the continuous power generating time is equal to or longer than the determination time T2, and if the voltage of the battery 17 is equal to or higher than the first voltage V1, for example. As a result of the determination at Step S220, if it is affirmed that the releasing condition has been satisfied, the control is shifted to Step S230. If the determination is denied at Step S220, the determination at Step S220 is repeated.

At Step S230, the control circuit 20 causes the electronic watch 1 to resume from the first power break mode PB1 to the normal mode. If Step S230 is executed, the control is shifted to Step S240.

At Step S240, the control circuit 20 determines whether today is the twentieth day from the date on which the first power break mode PB1 has been released. The control circuit 20 makes the determination at Step S240 based on the time elapsed from when the electronic watch 1 is resumed to the normal mode from the first power break mode PB1, for example. As a result, if it is affirmed that today is the 20th day from the date on which the electronic watch 1 is resumed from the first power break mode PB1, the control is shifted to Step S270. If the determination is denied, the control is shifted to Step S250.

At Step S250, the control circuit 20 determines whether today is the 10th day from the date on which the first power break mode PB1 has been released. As a result of the determination at Step S250, if it is affirmed that today is the 10th day from the date on which the electronic watch 1 is resumed from the first power break mode PB1, the control is shifted to Step S260. If the determination is denied, the control is shifted to Step S240.

At Step S260, the control circuit 20 determines whether the cumulative power generating time subsequent to the release of the first power break mode PB1 is equal to or longer than a determination time T10. The determination time T10 is a time shorter than a cumulative power generating time under average usage conditions over 10 days, for example. In other words, the determination time T10 is the upper boundary with which it is determined that the electronic watch 1 is used infrequently, that is, the upper boundary with which it is determined that the amount of generated power is insufficient. The determination time T10 is 1 hour, for example. As a result of the determination at Step S260, if it is affirmed that the cumulative power generating time is equal to or longer than T10, the control is shifted to Step S240. If the determination is denied, the control is shifted to Step S280.

At Step S270, the control circuit 20 determines whether the cumulative power generating time after the release is equal to or longer than a determination time T11. The determination time T11 is established using the same criteria used for the determination time T10. The determination time T11 is a time longer than the determination time T10 used at Step S260, and is twice to five times the determination time T10, for example. The determination time T11 may be set as 2 or 5 hours. The determination time T11 may be set to a power generating time for generating the power that is determined by multiplying the consumed power of the electronic watch 1 over 1 day under the normal usage conditions by the number of days from the release of the first power break mode PB1 to the determination of transition to the first power break mode PB1. As a result of the determination at Step S270, if it is affirmed that the power generating time is equal to or longer than the cumulative determination time T11, the control is shifted to Step S290. If the determination is denied, the control is shifted to Step S280.

At Step S280, the control circuit 20 causes the electronic watch 1 to transit to the first power break mode PB1. The control circuit 20 causes the electronic watch 1 to transit to the first power break mode PB1 if it is determined that the electronic watch 1 is not in use, for example. In such a case, the control circuit 20 may determine that the electronic watch 1 is not in use if no power is being generated by the power generating mechanism 21. Alternatively, the control circuit 20 may also cause the electronic watch 1 to transit to the first power break mode PB1 if the condition for transiting from the normal mode to the first power saving mode PS1 is satisfied. If the electronic watch 1 transits from the normal mode to the first power break mode PB1, this control sequence is ended.

At Step S290, the control circuit 20 sets the first determination time P1 to 1 month. If Step S290 is executed, this control sequence is ended.

In the flowchart illustrated in FIG. 9, if the determination is denied at Step S260 or Step S270, the first determination time P1 may be changed, instead of causing electronic watch 1 to transit to the first power break mode PB1. For example, if the determination is denied at Step S260 or Step S270, the first determination time P1 may be set to a period shorter than 1 month at Step S280.

A method for determining the condition for transiting to the first power break mode PB1 based on the voltage of the battery 17 will now be explained with reference to FIG. 10. The control sequence illustrated in FIG. 10 is started in the first power break mode PB1, for example. At Step S310, the control sequence of the control circuit 20 is started when the power becomes generated by the power generating mechanism 21.

At next Step S320, the control circuit 20 determines whether a condition for releasing the first power break mode PB1 has been satisfied. The control circuit 20 affirms the determination at Step S320 if the continuous power generating time is equal to or longer than the determination time T2, and if the voltage of the battery 17 is equal to or higher than the first voltage V1, for example. As a result of the determination at Step S320, if it is affirmed that the releasing condition has been satisfied, the control is shifted to Step S330. If the determination is denied, the determination at Step S320 is repeated.

At Step S330, the control circuit 20 causes the electronic watch 1 to resume from the first power break mode PB1. If Step S330 is executed, the control is shifted to Step S340.

At Step S340, the control circuit 20 determines whether the remaining charge of the battery 17 is equal to or less than a first remaining charge. The first remaining charge is 20 percent of the capacity of the battery 17, for example. As a result of the determination at Step S340, if it is affirmed that the remaining charge of the battery is equal to or less than the first remaining charge, the control is shifted to Step S370. If the determination is denied, the control is shifted to Step S350.

At Step S350, the control circuit 20 determines whether the remaining charge of the battery 17 is equal to or less than a second remaining charge. The second remaining charge is greater than the first remaining charge. The second remaining charge is 50 percent, for example. As a result of the determination at Step S350, if it is affirmed that the remaining charge of the battery is equal to or less than the second remaining charge, the control is shifted to Step S380. If the determination is denied, the control is shifted to Step S360.

At Step S360, the control circuit 20 sets the first determination time P1 to 1 month. If Step S360 is executed, this control sequence is ended.

At Step S370, the control circuit 20 sets the first determination time P1 to 10 days. If Step S370 is executed, this control sequence is ended. In other words, when the remaining charge of the battery is low, the first determination time P1 is short compared with when the remaining charge of the battery is high.

At Step S380, the control circuit 20 sets the first determination time P1 to 20 days. If Step S380 is executed, this control sequence is ended.

With the flowchart illustrated in FIG. 10, the condition for transiting from the first power saving mode PS1 to the first power break mode PB1 is changed depending on the remaining charge of the battery 17 at the time of transition from the first power break mode PB1 to the normal mode. More specifically, when the remaining charge of the battery 17 is low, the first determination time P1 for transiting from the first power saving mode PS1 to the first power break mode PB1 is short compared with when the remaining charge of the battery 17 is high. Furthermore, as the remaining charge of the battery becomes reduced, the first determination time P1 becomes shorter. According to the modification, when the remaining charge of the battery 17 is low, the electronic watch 1 is caused to transit to the first power break mode PB1 within a short time period after transiting to the first power saving mode PS1. As a result, a voltage drop in the battery 17 is suppressed. After the release of the first power break mode PB1 and the transition to the normal mode, if the remaining charge of the battery is increased or decreased due to the power consumption status or the power generation status of the watch, the first determination time P1 that has been set at the time of releasing the first power break mode PB1 may be changed. More specifically, the first determination time P1 may be set to 10 days in response to the release of the first power break mode PB1, and then the first determination time P1 may be set to 20 days again if the remaining charge of the battery exceeds 20% of the amount of charge in the fully charged battery 17.

A method for determining the condition for transiting to the first power break mode PB1 based on the cumulative power generating time and the battery voltage will now be explained with reference to FIG. 11. The control sequence illustrated in FIG. 11 is started in the first power break mode PB1, for example. At Step S410, the control sequence of the control circuit 20 is started when the power becomes generated by the power generating mechanism 21.

At next Step S420, the control circuit 20 determines whether a condition for releasing the first power break mode PB1 has been satisfied. The control circuit 20 affirms the determination at Step S420 if the continuous power generating time is equal to or longer than the determination time T2, and if the voltage of the battery 17 is equal to or higher than the first voltage V1, for example. As a result of the determination at Step S420, if it is affirmed that the releasing condition has been satisfied, the control is shifted to Step S430. If the determination is denied, the determination at Step S420 is repeated.

At next Step S430, the control circuit 20 resumes the watch 1 from the first power break mode PB1. If Step S430 is executed, the control is shifted to Step S440.

At Step S440, the control circuit 20 determines whether the remaining charge of the battery is equal to or less than the first remaining charge. The first remaining charge is 20 percent of the capacity of the battery 17, for example. As a result of the determination at Step S440, if the determination is affirmed, the control is shifted to Step S450. If the determination is denied, the control is shifted to Step S500.

At Step S450, the control circuit 20 determines whether today is the 20th day from the date on which the first power break mode PB1 has been released. As a result of the determination at Step S450, if it is determined that today is the 20th day from the resumed date, the control is shifted to Step S480. If the determination is denied, the control is shifted to Step S460.

At Step S460, the control circuit 20 determines whether today is the 10th day from the date on which the first power break mode PB1 has been released. As a result of the determination at Step S460, if it is determined that today is the 10th day, the control is shifted to Step S470. If the determination is denied, the control is shifted to Step S440.

At Step S470, the control circuit 20 determines whether the cumulative power generating time after the release is equal to or longer than the determination time T10. The determination time T10 is 1 hour, for example. As a result of the determination at Step S470, if it is affirmed that the power generating time is equal to or longer than the cumulative determination time T10, the control is shifted to Step S440. If the determination is denied, the control is shifted to Step S490.

At Step S480, the control circuit 20 determines whether the cumulative power generating time after the release is equal to or longer than the determination time T11. The determination time T11 is longer than the determination time T10, and is 2 hours, for example. As a result of the determination at Step S480, if it is affirmed that the power generating time is equal to or longer than the cumulative determination time T11, the control is shifted to Step S560. If the determination is denied, the control is shifted to Step S490.

At Step S490, the control circuit 20 causes the electronic watch 1 to transit to the first power break mode PB1. If it is determined that the electronic watch 1 is not in use, for example, the control circuit 20 causes the electronic watch 1 to transit to the first power break mode PB1. In such a case, the control circuit 20 may determine that the electronic watch 1 is not in use when no power is being generated by the power generating mechanism 21. Alternatively, the control circuit 20 may cause the electronic watch 1 to transit to the first power break mode PB1 if the condition for transiting from the normal mode to the first power saving mode PS1 is satisfied. If the electronic watch 1 transits from the normal mode to the first power break mode PB1, this control sequence is ended.

At Step S500, the control circuit 20 determines whether the remaining charge of the battery is equal to or less than the second remaining charge. The second remaining charge is higher than the first remaining charge, and is 50 percent, for example. As a result of the determination at Step S500, if the determination is affirmed, the control is shifted to Step S510. If the determination is denied, the control is shifted to Step S560.

At Step S510, the control circuit 20 determines whether today is the 20th day from the date on which the first power break mode PB1 has been released. As a result of the determination at Step S510, if it is determined that today is the 20th day from the resumed date, the control is shifted to Step S540. If the determination is denied, the control is shifted to Step S520.

At Step S520, the control circuit 20 determines whether today is the 10th day from the date on which the first power break mode PB1 has been released. As a result of the determination at Step S520, if it is affirmed that today is the 10th day, the control is shifted to Step S530. If the determination is denied, the control is shifted to Step S440.

At Step S530, the control circuit 20 determines whether the cumulative power generating time after the release is equal to or longer than a determination time T12. The determination time T12 is a time shorter than the determination time T10 used at Step S470, and is a time equal to a half the determination time T10, for example. The determination time T12 may be set to 30 minutes. As a result of the determination at Step S530, if it is affirmed that the power generating time is equal to or longer than the cumulative determination time T12, the control is shifted to Step S440. If the determination is denied, the control is shifted to Step S550.

At Step S540, the control circuit 20 determines whether the cumulative power generating time after the release is equal to or longer than a determination time T13. The determination time T13 is a time shorter than the determination time T11 used at Step S480, and is a time equal to a half the determination time T11, for example. The determination time T13 may be set to 1 hour, for example. As a result of the determination at Step S540, if it is affirmed that the power generating time is equal to or longer than the cumulative determination time T13, the control is shifted to Step S560. If the determination is denied, the control is shifted to Step S550.

At Step S550, the control circuit 20 causes the electronic watch 1 to transit to the first power break mode PB1. For example, the control circuit 20 causes the electronic watch 1 to transit to the first power break mode PB1 if it is affirmed that the electronic watch 1 is not in use. In such a case, the control circuit 20 may determine that the electronic watch 1 is not in use if no power is being generated by the power generating mechanism 21. Alternatively, the control circuit 20 may cause the electronic watch 1 to transit to the first power break mode PB1 if the condition for transiting from the normal mode to the first power saving mode PS1 is satisfied. If the electronic watch 1 transits from the normal mode to the first power break mode PB1, this control sequence is ended.

At Step S560, the control circuit 20 sets the first determination time P1 to 1 month. If Step S560 is executed, this control sequence is ended.

In the flowchart illustrated in FIG. 11, if the determination is denied at Step S470, Step S480, Step S530, and Step S540, the first determination time P1 may be changed, instead of causing the electronic watch 1 to transit to the first power break mode PB1. For example, the first determination time P1 may be set to a period shorter than 1 month.

As explained above, the control circuit 20 according to the third modification of the embodiment reduces the length of the first determination time P1 when a small amount of power has been generated by the power generating mechanism 21 over a certain time period in the past (No at S270 in FIG. 9, for example), compared with when a large amount of power has been generated by the power generating mechanism 21 (Yes at S270 in FIG. 9, for example). In the example illustrated in FIG. 9, when the amount of power generated by the power generating mechanism 21 is small, the first determination time P1 is set to substantially zero. According to the modification, when the amount of power generated is insufficient, the electronic watch 1 is caused to transit to the first power break mode PB1 at an early stage.

Furthermore, the control circuit 20 according to the third modification reduces the length of the first determination time P1 when the voltage of the battery 17 is low (Yes at Step S350 in FIG. 10, for example), compared with when the voltage of the battery 17 is high (No at Step S350 in FIG. 10, for example) (Step S380). Therefore, when the battery voltage is low, the electronic watch 1 is caused to transit to the first power break mode PB1 at an early stage so that the consumption of power is suppressed.

Furthermore, the control circuit 20 according to the third modification reduces the length of the first determination time P1 more when the voltage of the battery 17 is lower. For example, when the remaining charge of the battery is equal to or less than 20 percent (No at Step S340 in FIG. 10), the first determination time P1 is set to 10 days that is the shortest. If the remaining charge of the battery is higher than 20 percent and is equal to or less than 50 percent (Yes at Step S350 in FIG. 10), the first determination time P1 is set to 20 days. If the remaining charge of the battery is over 50 percent (No at Step S350 in FIG. 10), the first determination time P1 is set to 1 month that is the longest. Therefore, as the remaining charge of the battery becomes lower, the time within which the electronic watch 1 is caused to transit to the first power break mode PB1 is reduced so that the consumption of power is suppressed.

Fourth Modification of Embodiment

Figure 12:
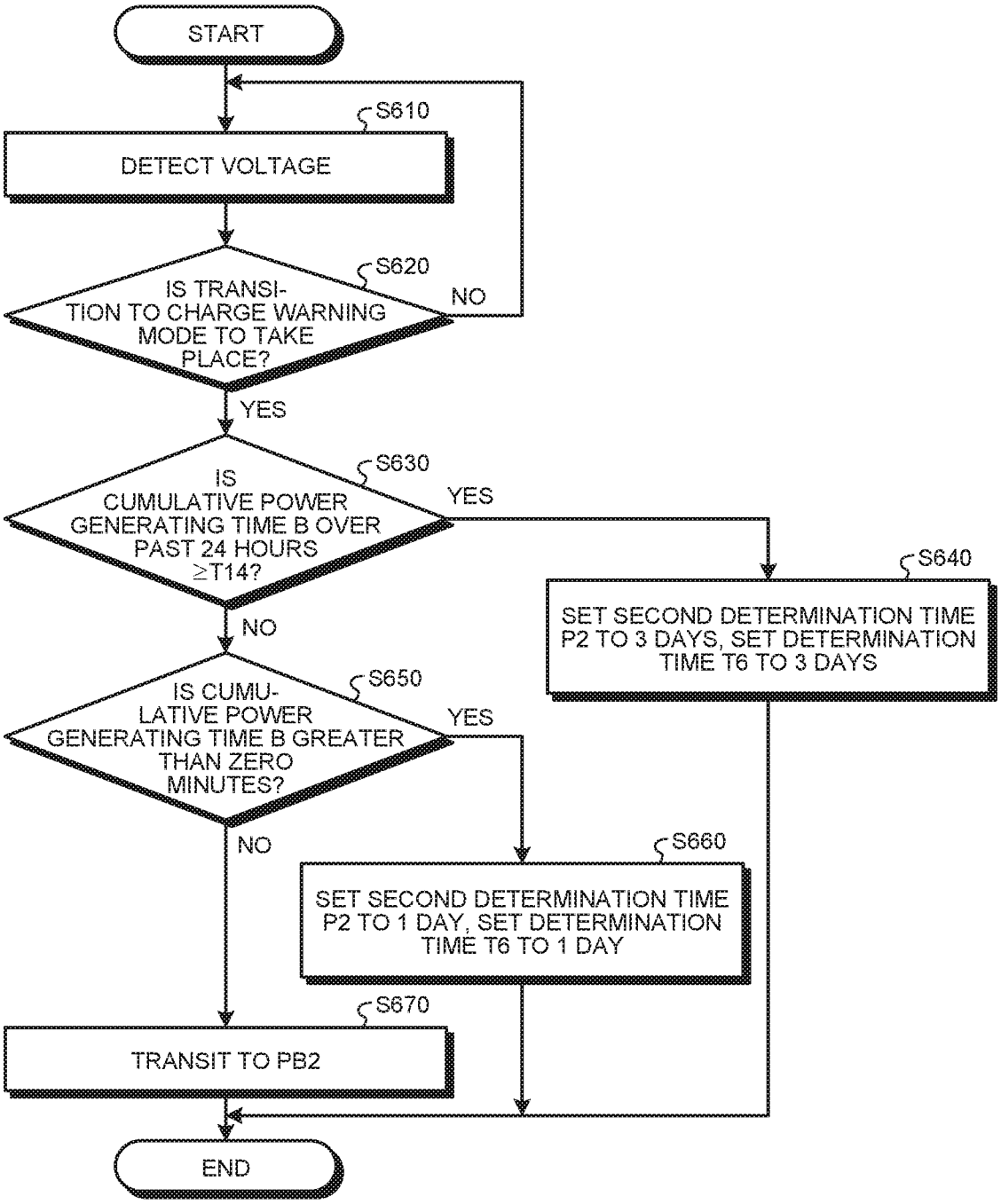
FIG. 12 is a flowchart according to a fourth modification of the embodiment.

A fourth modification of the embodiment will now be explained. FIG. 12 is a flowchart according to the fourth modification of the embodiment. The fourth modification of the embodiment is different from the embodiment described above in that the charge warning period is determined based on the most recent power generation status, for example.

A method for determining the charge warning period according to the fourth modification of the embodiment will now be explained with reference to FIG. 12. The control sequence illustrated in FIG. 12 is started in the time correction mode, for example. At Step S610, the control circuit 20 detects the voltage of the battery 17. If Step S610 is executed, the control is shifted to Step S620.

At Step S620, the control circuit 20 determines whether to cause the electronic watch 1 to transit to the charge warning mode WNG. If the battery voltage detected at Step S610 is equal to or lower than the lower-boundary voltage VL, for example, the control circuit 20 determines to transit to the charge warning mode WNG. As a result of the determination at Step S620, if the determination is affirmed, the control is shifted to Step S630. If the determination is denied, the control is shifted to Step S610.

At Step S630, the control circuit 20 determines whether a cumulative power generating time B over a certain period ending at the current time is equal to or longer than the determination time T14. The certain period is 24 hours, for example. The determination time T14 is 30 minutes, for example. As a result of the determination at Step S630, if it is affirmed that the cumulative power generating time B is equal to or longer than the determination time T14, the control is shifted to Step S640. If the determination is denied, the control is shifted to Step S650.

At Step S640, the control circuit 20 sets the second determination time P2 to 3 days. The second determination time P2 is a time with which the control circuit 20 determines whether to transit from the second power saving mode PS2 to the second power break mode PB2. The control circuit 20 also sets the determination time T6 to 3 days. The determination time T6 is a time with which the control circuit 20 determines whether to transit from the charge warning mode WNG to the second power break mode PB2. The control circuit 20 causes the electronic watch 1 to transit to the charge warning mode WNG, sets a determination period with which the transition to the second power break mode PB2 is determined to 3 days. If Step S640 is executed, this control sequence is ended.

At Step S650, the control circuit 20 determines whether the cumulative power generating time B is greater than zero minutes. As a result of the determination at Step S650, if it is affirmed that the cumulative power generating time B is greater than zero minutes, the control is shifted to Step S660. If the determination is denied, the control is shifted to Step S670.

At Step S660, the control circuit 20 sets the second determination time P2 and the determination time T6 to 1 day. The control circuit 20 then causes the electronic watch 1 to transit to the charge warning mode WNG, sets the determination period with which the transition to the second power break mode PB2 is determined to 1 day. In other words, when the cumulative power generating time B is short, the second determination time P2 and the determination time T6 are set shorter, compared with when the cumulative power generating time B is long. If Step S660 is executed, this control sequence is ended.

At Step S670, the control circuit 20 then causes the electronic watch 1 to transit to the second power break mode PB2. In other words, when the cumulative power generating time B is zero, the charge warning mode WNG is skipped, and the electronic watch 1 is caused to transit from the normal mode to the second power break mode PB2. If Step S670 is executed, this control sequence is ended.

According to the fourth modification of the embodiment, if the most recent cumulative power generating time B is short, the length of the charge warning time is reduced. If the cumulative power generating time B is short, it is more likely for the battery voltage to become low in the charge warning mode WNG. Although the electronic watch 1 according to the fourth modification of the embodiment prompts the user to charge by indicating the charge warning with a sufficient period that is ensured when the cumulative power generating time B is long, the electronic watch 1 can suppress a drop in the battery voltage by reducing the length of the charge warning time when the cumulative power generating time B is short.

The threshold value of the cumulative power generating time B may be determined based on a usage condition of the electronic watch 1 by a general user. For example, the second determination time P2 or the determination time T6 may be decided based on the ratio of the cumulative power generating time B with respect to the power generating time corresponding to the usage condition of a general user (hereinafter referred to as "standard power generating time"). In such a case, at Step S630, it may be determined whether the cumulative power generating time B represents a ratio equal to or lower than 50 percent of the standard power generating time. Furthermore, at Step S650, it may be determined whether the cumulative power generating time B represents a ratio equal to or higher than 20 percent of the standard power generating time.

A condition for resuming from the charge warning mode WNG may be configured to be variable depending on the cumulative power generating time B. For example, the control circuit 20 may cause the electronic watch 1 to resume from the charge warning mode WNG if the cumulative power generating time B over the past certain period is equivalent to the standard power generating time. If the cumulative power generating time B is equal to or more than 30 percent of the standard power generating time, the control circuit 20 may determine whether to resume from charge warning mode WNG under the same condition as that used in the embodiment.

Fifth Modification of Embodiment

Figure 13:
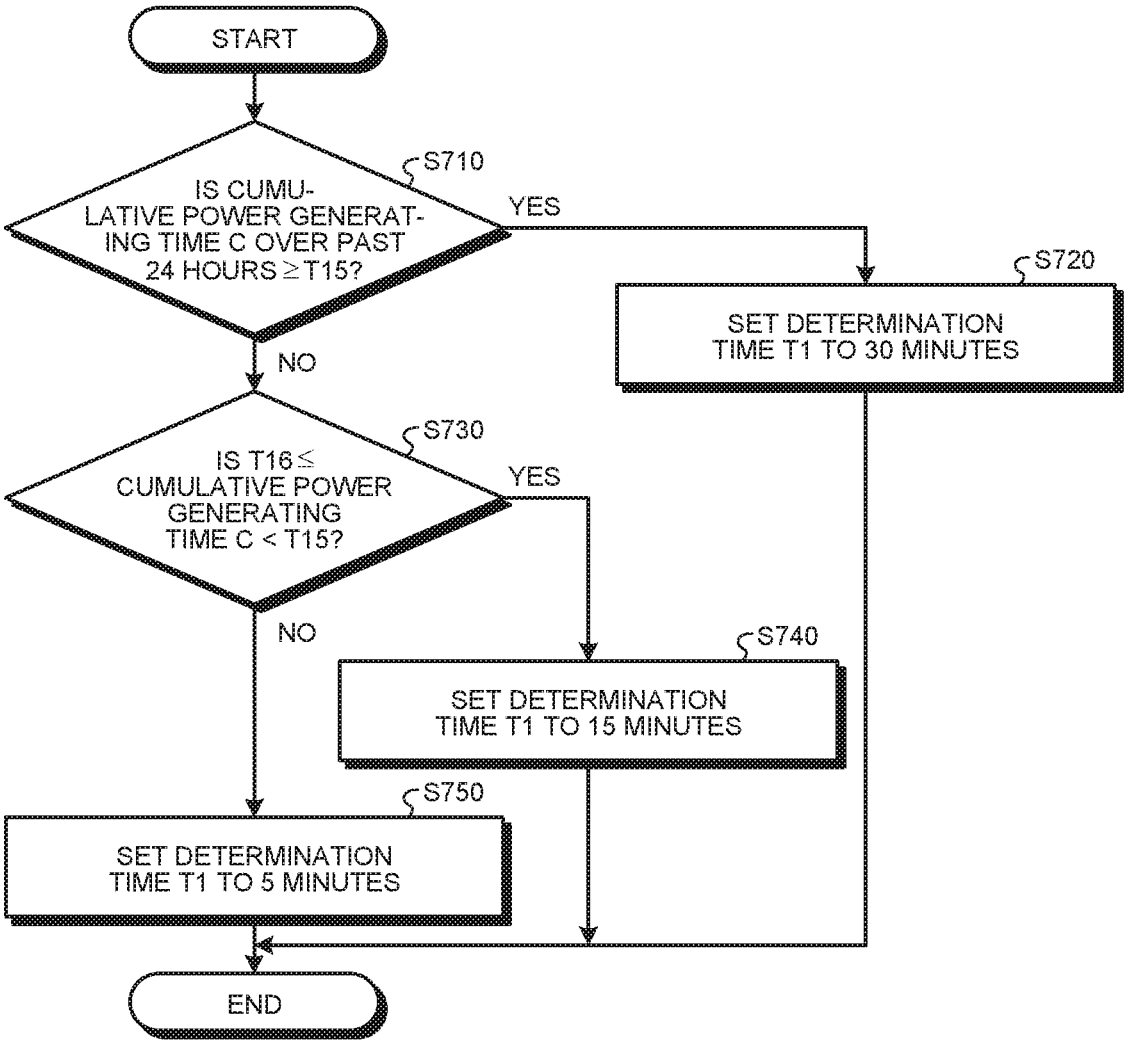
FIG. 13 is a flowchart according to a fifth modification of the embodiment.
Figure 14:
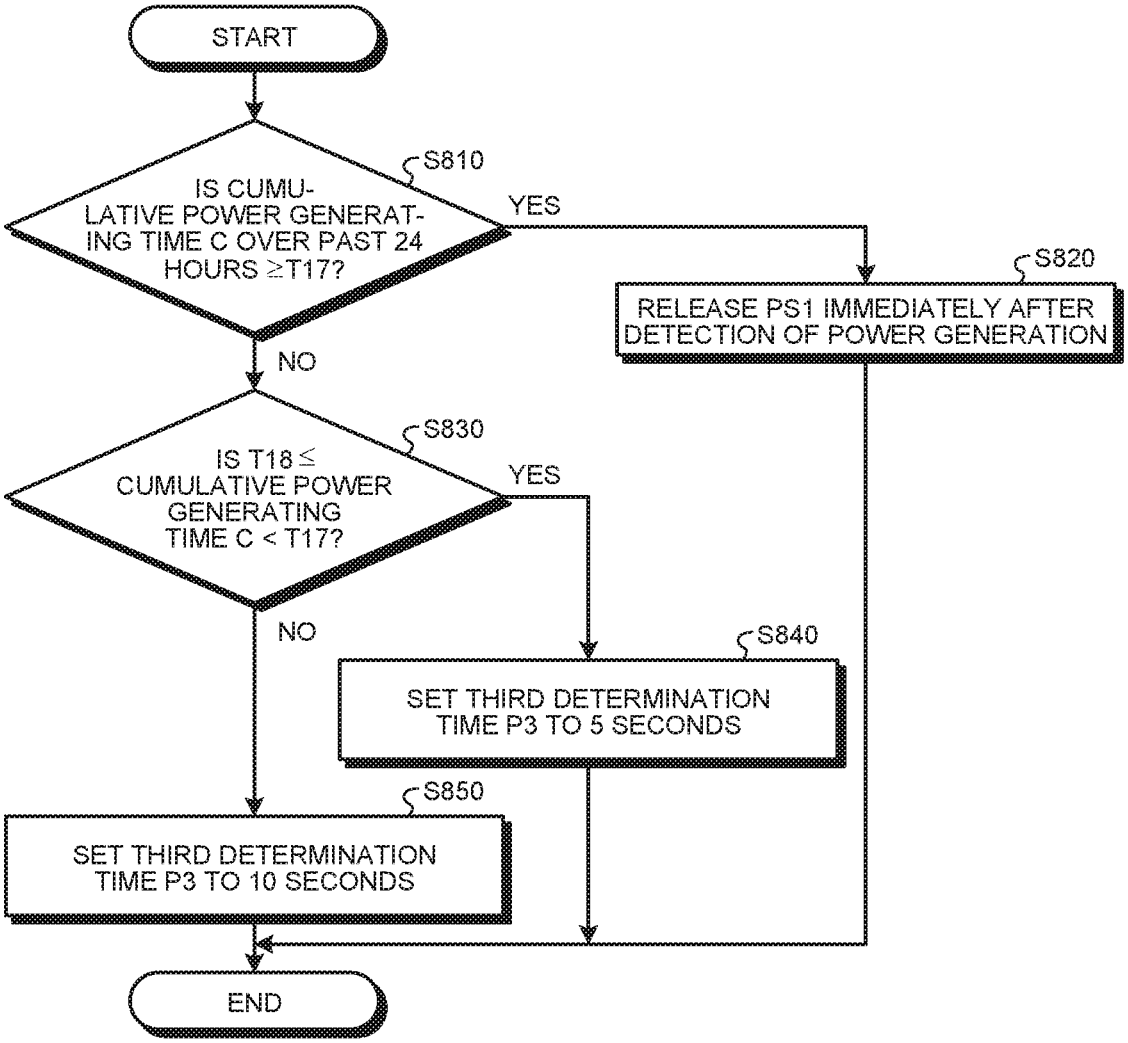
FIG. 14 is another flowchart according to the fifth modification of the embodiment.

A fifth modification of the embodiment will now be explained. FIG. 13 is a flowchart according to the fifth modification of the embodiment, and FIG. 14 is another flowchart according to the fifth modification of the embodiment. The fifth modification of the embodiment is different from the embodiment described above in that, for example, the condition for transiting to the power saving mode or the condition for resuming from the power saving mode is determined based on the cumulative power generating time.

A method for determining the condition for transiting to the power saving mode according to the fifth modification of the embodiment will now be explained with reference to FIG. 13. The control sequence illustrated in FIG. 13 is started in the normal mode, for example. At Step S710, the control circuit 20 determines whether a cumulative power generating time C over a certain period ending at the current time is equal to or longer than a determination time T15. The certain period is 24 hours, for example. The determination time T15 is 1 hour, for example. As a result of the determination at Step S710, if it is affirmed that the cumulative power generating time C is equal to or longer than the determination time T15, the control is shifted to Step S720. If the determination is denied, the control is shifted to Step S730.

At Step S720, the control circuit 20 sets the determination time T1 with which the transition from the normal mode to the power saving mode is determined to 30 minutes. As a result, if the condition without any power generation by the power generating mechanism 21 persists 30 minutes, the electronic watch 1 is caused to transit to the first power saving mode PS1. If Step S720 is executed, this control sequence is ended.

At Step S730, the control circuit 20 determines whether the cumulative power generating time C is equal to or longer than the determination time T16 and is shorter than the determination time T15. The determination time T16 is a time shorter than the determination time T15, and is 30 minutes, for example. As a result of the determination at Step S730, if it is affirmed that the value of the cumulative power generating time C is within the above-mentioned range, the control is shifted to Step S740. If the determination is denied, the control is shifted to Step S750.

At Step S740, the control circuit 20 sets the determination time T1 to 15 minutes. In other words, if the cumulative power generating time C is short, the control circuit 20 sets a smaller value to the determination time T1 with which the transition to the first power saving mode PS1 is determined, compared with when the cumulative power generating time C is long. If Step S740 is executed, this control sequence is ended.

At Step S750, the control circuit 20 sets the determination time T1 to 5 minutes. In other words, when the cumulative power generating time C is shorter, the control circuit 20 sets a smaller value to the determination time T1. If Step S740 is executed, this control sequence is ended.

A method for determining the condition for resuming from the power saving mode will now be explained with reference to FIG. 14. The control sequence illustrated in FIG. 14 may be executed in the normal mode, or may be executed upon completion of a transition to the first power saving mode PS1. At Step S810, the control circuit 20 determines whether the cumulative power generating time C over a certain period ending at the current time is equal to or longer than the determination time T17. The certain period is 24 hours, for example. To the determination time T17, the same value as that set to the determination time T15 at Step S710 may be set. As a result of the determination at Step S810, if it is affirmed that the cumulative power generating time C is equal to or longer than the determination time T17, the control is shifted to Step S820. If the determination is denied, the control is shifted to Step S830.

At Step S820, the control circuit 20 sets the third determination time P3 to zero. As a result, the electronic watch 1 is resumed to the normal mode from the first power saving mode PS1 immediately after the power generating mechanism 21 is detected to be generating power in the first power saving mode PS1. If Step S820 is executed, this control sequence is ended.

At Step S830, the control circuit 20 determines whether the cumulative power generating time C is equal to or longer than the determination time T18 and is shorter than the determination time T17. The determination time T18 is time shorter than the determination time T17. To the determination time T18, the same value set to the determination time T16 at Step S730 may be set. As a result of the determination at Step S830, if it is affirmed that the cumulative power generating time C is equal to or longer than the determination time T18 and is shorter than the determination time T17, the control is shifted to Step S840. If the determination is denied, the control is shifted to Step S850.

At Step S840, the control circuit 20 sets the third determination time P3 to 5 seconds. If the power generating time then becomes equal to or longer than the third determination time P3, the control circuit 20 causes the electronic watch 1 to resume from the first power saving mode PS1 to the normal mode. In this modification, if the cumulative power generating time C is short, the control circuit 20 uses a longer third determination time P3 with which a determination as to whether to resume from the first power saving mode PS1 is made, compared with when the cumulative power generating time C is long. If Step S840 is executed, this control sequence is ended.

At Step S850, the control circuit 20 sets the third determination time P3 to 10 seconds. In other words, when the cumulative power generating time C is shorter, the control circuit 20 sets a longer third determination time P3. If Step S850 is executed, this control sequence is ended.

In the manner described above, if the cumulative power generating time C is short, the electronic watch 1 according to the fifth modification of the embodiment is caused to transit from the normal mode to the first power saving mode PS1 within a short time period from when the power generation stops. Furthermore, if the cumulative power generating time C is short, the electronic watch 1 is not resumed from the first power saving mode PS1 to the normal mode until the battery 17 is charged to a sufficient level. Therefore, in the electronic watch 1 according to this modification, a voltage drop in the battery 17 is appropriately suppressed. By contrast, if the cumulative power generating time C is long, the electronic watch 1 is not caused to transit to the first power saving mode PS1 immediately even if the power generation stops. Furthermore, if the cumulative power generating time C is long, the electronic watch 1 resumes from the first power saving mode PS1 immediately once power generation is detected in the first power saving mode PS1. Therefore, the electronic watch 1 according to the fifth modification of the embodiment can achieve appropriate mode transitions based on the balance between the power generated and the power spent.

Sixth Modification of Embodiment

The electronic watch 1 may include a resuming determining circuit for determining whether to resume to the normal mode, in the first power break mode PB1 or the second power break mode PB2. The resuming determining circuit operates using the power generated by the power generating mechanism 21. The resuming determining circuit performs operations such as counting the power generating time and monitoring the voltage of the battery 17, and determines whether to resume from the power break modes PB1, PB2. Because resuming determining circuit operates using the generated power, the consumption of the battery 17 is suppressed.

If the power supply to all of the circuits included in the control circuit 20 is continuously stopped in the first and the second power break mode, the power consumption can be significantly suppressed, but the operations of elements such as the counter, the comparator circuit, and the power supply regulator become unavailable. Therefore, when the power supply to the control circuit 20 is stopped, power is supplied to the control circuit 20 intermittently, and the control circuit 20 is caused to operate at the timing of the power supply, to determine whether to resume the mode. Furthermore, it is also possible to provide the resuming determining circuit separately from the control circuit 20, to temporarily store the power generated by the power generating mechanism 21 in a capacitor, and to use the power to cause the resuming determining circuit to operate and to determine whether to resume to the normal mode. It is also possible to supply power to the control circuit 20 upon satisfaction of a resuming condition. In this manner, a current consumption of the battery 17 can be suppressed significantly, while enabling the control circuit 20 to determine whether to resume to the normal mode in the power break mode.

The electronic watch 1 may include a mode transiting circuit for causing the electronic watch 1 to transit from the first power break mode PB1 to the second power break mode PB2. Such a mode transiting circuit has a function for monitoring the voltage of the battery 17, and the function for determining whether to transit from the first power break mode PB1 to the second power break mode PB2.

In the second power break mode PB2, because the voltage of the battery 17 is low, a stricter condition needs to be satisfied to resume to the normal mode, compared to that used in the first power break mode PB1, so that a sufficient voltage is ensured in the battery 17 before the electronic watch 1 is resumed to the normal mode. However, if the condition without any power generation persists in the first power break mode PB1, the battery voltage drops due to the effect of self-discharge or the like, and as a result, the watch 1 is caused to transit to the second power saving mode PS2 immediately after resuming to the normal mode under the condition of the arrow Y4, and keeps consuming power. Hence, it requires some time for the watch 1 to transit to the second power break mode PB2. Therefore, not only the power of the battery 17 is wastefully consumed, but also a user may get confused because the hand points to the charge warning indicator immediately after resuming to the normal operation. Therefore, in this embodiment, if the electronic watch 1 transits to the first power break mode PB1, and the voltage of the battery 17 drops to a level equal to or lower than the lower-boundary voltage VL, the watch 1 is caused to transit to the second power break mode PB2, and is not resumed to the normal mode unless the condition of the arrow Y8 is satisfied.

The mode transiting circuit is configured as a circuit that is separate from the control circuit 20, for example. The mode transiting circuit operates with the power supplied by the battery 17, for example. The mode transiting circuit causes the electronic watch 1 to transit from the first power break mode PB1 to the second power break mode PB2 when the voltage of the battery 17 drops to a level equal to or lower than the lower-boundary voltage VL. The mode transiting circuit stores the current mode of the electronic watch 1 in a storage unit. The control circuit 20 then determines whether to resume to the normal mode or to the time correction mode based on the mode of the electronic watch 1 stored in the storage unit.

The power generating mechanism 21 is not limited to an electrostatic induction power generator. It is also possible to use a thermal power generating mechanism, a small-sized electromagnetic power generating mechanism, or ring solar cells, as the power generating mechanism 21. The thermal power generating mechanism generates power based on a difference between the ambient temperature and a body temperature, for example.

In at least one of the first power break mode PB1 and the second power break mode PB2, the function for calculating the internal time (timing circuit) may be enabled in the control circuit 20. In other words, it is possible to achieve the power saving by stopping the functions of the control circuit 20 except for that for calculating the internal time.

The configurations disclosed in the embodiment and the modifications above may be executed in a combined fashion as appropriate.

An electronic watch according to the present embodiment and modifications include a power generating mechanism; a battery that is charged with power generated by the power generating mechanism; hands that include a second hand; a driving source that rotates the hands; a driving circuit that drives the driving source with power supplied by the battery; and a control circuit that controls the driving circuit. The control circuit executes a first stopping operation for stopping the driving circuit and the control circuit in a power saving mode for suppressing power consumption and when a first determination time elapses without any power being generated by the power generating mechanism. The control circuit executes a second stopping operation for stopping the driving circuit and the control circuit in the power saving mode and when a second determination time elapses while a voltage of the battery is at a level equal to or lower than a predetermined level.

The electronic watch according to the present embodiment and modifications execute the first stopping operation that is based on the time elapsed without any power generation, and the second stopping operation that is based on the time elapsed with a battery voltage equal to or lower than a predetermined level. Therefore, with the electronic watch according to the present embodiment and modifications, it is possible to suppress a drop in the battery voltage, and to achieve an extension of the operating time, advantageously.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electronic watch comprising:

a power generating mechanism;

a battery that is charged with power generated by the power generating mechanism;

hands that include a second hand;

a driving source that rotates the hands;

a driving circuit that drives the driving source with power supplied by the battery; and a control circuit that controls the driving circuit, wherein the control circuit executes a first stopping operation for stopping the driving circuit and the control circuit in a power saving mode for suppressing power consumption and when a first determination time elapses without any power being generated by the power generating mechanism, the control circuit executes a second stopping operation for stopping the driving circuit and the control circuit in the power saving mode and when a second determination time elapses while a voltage of the battery is at a level equal to or lower than a predetermined level, wherein the power saving mode stops at least the second hand among the hands to suppress power consumption, the power saving mode includes a first power saving mode for stopping the second hand when a condition without any power generation by the power generating mechanism persists, and a second power saving mode for stopping the second hand when a voltage of the battery is low, and the control circuit stops the second hand at a first position in the first power saving mode, and stops the second hand at a second position that is different from the first position in the second power saving mode.

2. The electronic watch according to claim 1, wherein the second determination time in the second power saving mode is shorter than the first determination time in the first power saving mode.

3. The electronic watch according to claim 1, wherein when executing the first stopping operation in the first power saving mode, the control circuit stops the driving circuit and the control circuit with the second hand kept at the first position, and when executing the second stopping operation in the second power saving mode, the control circuit stops the driving circuit and the control circuit with the second hand kept at the second position.

4. The electronic watch according claim 1, wherein when a voltage of the battery drops in the first power saving mode, the control circuit causes a transition to the second power saving mode.

5. The electronic watch according to claim 1, wherein the control circuit starts moving the second hand when a power generating time of the power generating mechanism becomes equal to or longer than a third determination time in the first power saving mode, and starts moving the second hand when the power generating time of the power generating mechanism becomes equal to or longer than a fourth determination time in the second power saving mode, and the fourth determination time is longer than the third determination time.

6. The electronic watch according to claim 5, wherein in the first power saving mode, the control circuit determines whether to start a movement of the second hand based on a result of comparing the third determination time with a continuous power generating time of the power generating mechanism, and in the second power saving mode, the control circuit determines whether to start a movement of the second hand based on a result of comparing the fourth determination time with a cumulative power generating time of the power generating mechanism.

7. The electronic watch according to claim 1, wherein the control circuit executes the first stopping operation and the second stopping operation while the second hand has been stopped by a user operation performed on an operation unit.

8. The electronic watch according to claim 7, wherein the control circuit causes the driving circuit to stop the second hand in response to an operation performed on the operation unit, and when a voltage of the battery drops to a level equal to or lower than the predetermined level while the second hand is kept unmoving, the control circuit rotates the second hand to a warning position indicating a voltage drop in the battery, and stops the second hand at the warning position.

9. The electronic watch according to claim 1, wherein the control circuit performs a hand position detection in at least one of a time of transition to a power saving mode for suppressing power consumption by stopping the second hand, and a time of resuming from the power saving mode.

10. The electronic watch according to claim 1, wherein the control circuit performs a hand position detection in at least one of a time of executing the first stopping operation in the power saving mode, a time of executing the second stopping operation in the power saving mode, and a time of restarting operations of the driving circuit and the control circuit.

11. The electronic watch according to claim 1, wherein when the driving circuit and the control circuit have been stopped by the second stopping operation, the control circuit restarts operations of the driving circuit and the control circuit based on an amount of power generated by the power generating mechanism.

12. The electronic watch according to claim 1, wherein when an amount of power generated by the power generating mechanism within a certain past period is small, the control circuit reduces a length of the first determination time, compared with when the amount of power generated by the power generating mechanism is large within the period.

13. The electronic watch according to claim 1, wherein when a voltage of the battery is low, the control circuit reduces a length of the first determination time, compared with when the voltage of the battery is high.

14. The electronic watch according to claim 1, wherein when an amount of power generated by the power generating mechanism within a certain past period is small, the control circuit reduces a length of the second determination time, compared with when the amount of power generated by the power generating mechanism is large within the period.

15. The electronic watch according to claim 1, wherein when an amount of power generated by power generating mechanism within a certain past period is small, the control circuit starts the first power saving mode within a short time period after the power generating mechanism has ceased to generate power, compared with when the amount of power generated by the power generating mechanism is large within the period.

16. The electronic watch according to claim 1, wherein the control circuit starts moving the second hand when a power generating time of the power generating mechanism becomes equal to or longer than a predetermined time in the first power saving mode, and when an amount of power generated by the power generating mechanism within a certain period before the first power saving mode is started is large, the control circuit reduces a length of the predetermined time, compared with when the amount of power generated by the power generating mechanism within the period is small.

* * * * *